US009717656B2

(12) United States Patent
Lo

(10) Patent No.: US 9,717,656 B2
(45) Date of Patent: Aug. 1, 2017

(54) FEEDING APPARATUS

(71) Applicant: Dongguan Kidsme Industrial Limited, Dongguan, Guangdong (CN)

(72) Inventor: Fu Man Herman Lo, Hong Kong (HK)

(73) Assignee: Dongguan Kidsme Industrial Limited, Dongguan, Gunagdong (CN)

( * ) Notice: Subject to any disclaimer, the term of this patent is extended or adjusted under 35 U.S.C. 154(b) by 0 days.

(21) Appl. No.: 14/532,242

(22) Filed: Nov. 4, 2014

(65) Prior Publication Data

US 2015/0122674 A1 May 7, 2015

Related U.S. Application Data

(63) Continuation of application No. 13/941,562, filed on Jul. 15, 2013, which is a continuation of application (Continued)

(30) Foreign Application Priority Data

Mar. 10, 2009 (CN) ..... 2009 2 0135477
Jul. 22, 2009 (CN) ..... 2009 2 0306690
Nov. 4, 2009 (CN) ..... 2009 2 0314008

(51) Int. Cl.
*A61J 9/00* (2006.01)
*A61J 17/00* (2006.01)

(Continued)

(52) U.S. Cl.
CPC ..... *A61J 17/00* (2013.01); *A61J 9/001* (2013.01); *A61J 9/005* (2013.01); *A61J 9/08* (2013.01); *A61J 11/008* (2013.01); *A61J 11/0015* (2013.01); *A61J 11/04* (2013.01); *A61J 17/02* (2013.01)

(58) Field of Classification Search
CPC .... A61J 17/00; A61J 9/001; A61J 9/08; A61J 11/008; A61J 11/0015; A61J 9/005; A61J 11/04; A47G 19/02
See application file for complete search history.

(56) References Cited

U.S. PATENT DOCUMENTS 1,999,581 A 4/1935 Yager
2,096,961 A * 10/1937 condon ..... 215/11.6

(Continued)

FOREIGN PATENT DOCUMENTS

CN 2542248 Y 4/2003
CN 2735981 10/2005

(Continued)

OTHER PUBLICATIONS

Supplementary Search report issued by the European Patent Office for EP10750332.

(Continued)

*Primary Examiner* — Tri Mai
(74) *Attorney, Agent, or Firm* — White and Williams LLP

(57) ABSTRACT

A feeding apparatus includes a food container. The food container includes an open end and a closed end. The food container is provided on a surface thereof with one or more apertures. The food container is made of a resilient material for use with foodstuff.

6 Claims, 38 Drawing Sheets

Related U.S. Application Data

No. 12/782,723, filed on May 19, 2010, now Pat. No. 8,545,439, which is a continuation of application No. 12/713,179, filed on Feb. 26, 2010, now Pat. No. 8,597,235.

(51) Int. Cl.

| | |
|---|---|
| ***A61J 11/00*** | (2006.01) |
| ***A61J 9/08*** | (2006.01) |
| *A61J 11/04* | (2006.01) |
| *A61J 17/02* | (2006.01) |

(56) References Cited

U.S. PATENT DOCUMENTS

| | | | | |
|---|---|---|---|---|
| 2,223,179 | A * | 11/1940 | Lougheed | 215/11.1 |
| 2,665,693 | A * | 1/1954 | Pecora | 606/235 |
| 2,743,727 | A * | 5/1956 | Griesinger | 606/236 |
| 2,876,773 | A | 3/1959 | Witz | |
| 2,889,829 | A | 6/1959 | Tannenbaum et al. | |
| 2,954,030 | A * | 9/1960 | Jozwiak | 215/11.1 |
| 3,384,530 | A * | 5/1968 | Mercer | B29C 47/122 156/167 |
| 3,549,036 | A | 12/1970 | Ritsi | |
| 3,610,248 | A | 10/1971 | Davidson | |
| 3,742,950 | A | 7/1973 | Endrody | |
| 3,762,542 | A | 10/1973 | Grimes | |
| 4,192,307 | A | 3/1980 | Baer | |
| 4,574,100 | A * | 3/1986 | Mercer | B29D 28/00 264/288.8 |
| 4,623,069 | A | 11/1986 | White | |
| 4,765,497 | A | 8/1988 | Hsu | |
| 4,856,995 | A | 8/1989 | Wagner | |
| 4,896,666 | A * | 1/1990 | Hinkle | 128/202.13 |
| 4,959,051 | A | 9/1990 | Glass et al. | |
| 5,078,734 | A | 1/1992 | Noble | |
| 5,123,915 | A | 6/1992 | Miller et al. | |
| 5,395,392 | A | 3/1995 | Suhonen | |
| 5,462,101 | A | 10/1995 | Mouchmouchian | |
| 5,578,004 | A | 11/1996 | Liang | |
| 6,053,342 | A | 4/2000 | Chomik | |
| 6,110,193 | A | 8/2000 | Chen | |
| 6,161,710 | A | 12/2000 | Dieringer et al. | |
| 6,203,566 | B1 * | 3/2001 | Alanen et al. | 606/234 |
| 6,277,464 | B1 * | 8/2001 | Ronan | B01D 39/14 264/156 |
| 6,524,272 | B1 * | 2/2003 | Berry, Sr. | A61J 7/0046 604/77 |
| 7,901,375 | B2 * | 3/2011 | Dunn et al. | 604/77 |
| 2003/0018359 | A1 | 1/2003 | Tuckey et al. | |
| 2003/0236556 | A1 | 12/2003 | Dickerson | |
| 2004/0144744 | A1 | 7/2004 | Holley, Jr. | |
| 2004/0158200 | A1 | 8/2004 | Berry, Sr. | |
| 2004/0188373 | A1 | 9/2004 | Lewis et al. | |
| 2005/0245861 | A1 | 11/2005 | Dunn et al. | |
| 2005/0258123 | A1 | 11/2005 | Silver | |
| 2005/0284835 | A1 | 12/2005 | McKendry et al. | |
| 2007/0021782 | A1 | 1/2007 | Inoue et al. | |
| 2007/0203450 | A1 | 8/2007 | Berry | |
| 2007/0221604 | A1 | 9/2007 | Hakim | |
| 2008/0177305 | A1 | 7/2008 | Vath et al. | |
| 2008/0319479 | A1 | 12/2008 | Murphy Matro | |

FOREIGN PATENT DOCUMENTS

| | | |
|---|---|---|
| CN | 201088774 Y | 7/2008 |
| CN | 201108607 | 9/2008 |
| CN | 201108607 Y | 9/2008 |
| CN | 201275285 | 7/2009 |
| EP | 1113776 | 7/2001 |
| EP | 1275366 | 1/2003 |
| ES | 258262 | 11/1981 |
| ES | 1055586 | 12/2003 |
| ES | 1064926 | 5/2007 |
| ES | 1067041 | 4/2008 |
| ES | 1067973 | 8/2008 |
| GB | 536196 | 5/1941 |
| JP | S56109746 U | 8/1981 |
| JP | 05-041549 | 6/1993 |
| JP | 06-005637 | 1/1994 |
| JP | 3105120 U | 10/2004 |
| TW | 202592 | 3/1993 |
| TW | 333831 | 6/1998 |
| TW | 556554 | 10/2003 |
| WO | 85/04573 | 10/1985 |
| WO | 9942074 A1 | 8/1999 |
| WO | 03086266 | 10/2003 |

OTHER PUBLICATIONS

Search Report and Written Opinion of PCT patent application No. PCT/CN/2010/000724.

Search Report and Written Opinion of PCT patent application No. PCT/CN2010/070940.

UK Search Report of patent application No. GB1008313.7.

Search Report of Hong Kong Short-term patent application.

1st Office Action of counterpart Polish Patent Application No. P.393018 issued on Apr. 18, 2014.

Examination Report by the European Patent Office for European Patent Application No. 10801844.1.

Office Action issued by the Taiwanese Patent Office on Dec. 18, 2012 for the Taiwanese patent application No. 099116079.

Notification of Final Refusal for Spanish Utility Model Application No. 201030208.

English translation of the Summary of the Notification of Final Refusal for Spanish Utility Model Application No. 201030208.

Notification of Opposition Proceedings of the Spanish Utility Model Application No. 201030208.

English translation of the Summary of Notification of Opposition Proceedings of the Spanish Utility Model Application No. 201030208.

Opposition filed against Spanish Utility Model Application No. 201030208.

Examination Report of British Patent Application No. GB1003137.5 issued Sep. 24, 2010.

First Office Action of Korean Patent Application No. 10-2010-0067079.

English translation of the first Office Action of Korean Patent Application No. 10-2010-0067079.

1st Office Action of counterpart Chinese Patent Application No. 201080032737.1 issued Dec. 17, 2013.

2nd Office Action of counterpart Australian Patent Application No. 2010276032 issued Dec. 2, 2013.

1st Office Action of counterpart Australian Patent Application No. 2010276032 issued Aug. 27, 2013.

Examination Report of British Patent Application No. GB1003137.5 issued Jun. 18, 2010.

Search Report and Written Opinion of PCT patent application No. PCT/CN2010/070745.

Examination Report of British Patent Application No. GB1003137.5 issued Mar. 31, 2011.

* cited by examiner

FEEDING APPARATUS

CROSS-REFERENCE TO RELATED APPLICATIONS

This patent application is a continuation of U.S. patent application Ser. No. 13/941,562, filed on Jul. 15, 2013, which is a continuation of U.S. patent application Ser. No. 12/782,723, filed on May 19, 2010, now U.S. Pat. No. 8,545,439, which is a continuation-in-part application of U.S. patent application Ser. No. 12/713,179, filed on Feb. 26, 2010, now U.S. Pat. No. 8,597,235, which claims priority to Chinese Patent Application No. 200920135477.5, filed on Mar. 10, 2009, Chinese Patent Application No. 200920306690.8, filed on Jul. 22, 2009, and Chinese Patent Application No. 200920314008.X, filed on Nov. 4, 2009, the entire contents of which are hereby incorporated by reference.

FIELD OF PATENT APPLICATION

The present application relates to a feeding apparatus.

BACKGROUND

Milk bottles are used to contain liquid state food such as milk and beverage for feeding infants. However, there is no suitable feeding apparatus to hold small pieces of cut fruit such as pear, apple and vegetable for feeding infants. There is a need to provide a feeding apparatus that can be used to feed infants with food such as fruit, jelly, yoghurt, fish, meat, etc.

SUMMARY

In one aspect, a feeding apparatus includes a food container, and the food container includes an open end and a closed end. The food container is provided on a surface thereof with a plurality of apertures and a plurality of protrusions. The food container is made of a resilient material for use with foodstuff.

The protrusions may be formed on an outer surface and/or an inner surface of the food container.

The apertures may be circular in shape with a diameter of about 1 mm to about 5 mm.

The food container may include a plurality of apertures closer to the closed end and a plurality of apertures farther from the closed end. The dimension of the apertures closer to the closed end is smaller than the dimension of the apertures farther from the closed end.

The distance between two adjacent apertures may be about 2 mm to about 10 mm.

The protrusions may be formed between two adjacent apertures.

The resilient material for use with foodstuff may be selected from the group consisting of silicone, latex, and rubber.

The food container may be generally in the shape of a nipple of a milk-feeding bottle.

The shape of the food container may generally conform to the shape of the mouth of an infant.

The food container may taper into a rounded end in cross section.

The thickness of the food container may be about 1 mm to about 6 mm.

In another aspect, a feeding apparatus includes: a food container having an open end and a closed end; a first coupling member having an opening in communication with the open end of the container, the food container being coupled to the first coupling member; and a second coupling member cooperating with the first coupling member and movable between an open configuration allowing food to pass through the opening and into the food container, and a closed configuration where the second coupling member covers the opening of the first coupling member thereby sealing the open end of the food container. The food container is provided on a surface thereof with a plurality of apertures and a plurality of protrusions, the food container being made of a resilient material for use with foodstuff.

The second coupling member may include a food-squeezing unit, the food-squeezing unit is employed to squeeze the food inside the food-squeezing unit towards and into the food container.

The food-squeezing unit may include a squeezable container.

The food-squeezing unit may include a hollow barrel and a push member. The second opening is provided at one end of barrel and a third opening is provided at the other end of the barrel, and the push member is slidably movable inside the barrel.

The feeding apparatus may further include an intermediate member disposed between the second coupling member and the first coupling member for preventing the food inside the food container from moving back into the food-squeezing unit.

The intermediate member may include a casing with at least one blocking plate, the casing defines a central space in which the at least one blocking plate is mounted.

The intermediate member may include one blocking plate extending across a center of the casing.

The intermediate member may include two blocking plates formed into the shape of a cross.

The intermediate member may include three blocking plates formed into the shape of an asterisk.

BRIEF DESCRIPTION OF THE DRAWINGS

Specific embodiments of the feeding apparatus disclosed in the present application will now be described by way of example with reference to the accompanying drawings wherein:

FIG. 7 *a* is a top view of an annular projection provided on the feeding apparatus;

FIG. 7 *b* is a cross sectional view taken along line X-X of the annular projection in FIG. 7 *a;*

FIG. 55 *b* is a cross sectional view taken along line A-A of the food-dispensing member of FIG. 55 *a;*

FIG. 55 *c* is a front view of a thirteenth embodiment of the food-dispensing member of the feeding apparatus;

FIG. 56 *b* is a cross sectional view taken along line A-A of the food-dispensing member of FIG. 55 *a*; and FIG. 56 *c* is a front view of a fourteenth embodiment of the food-dispensing member of the feeding apparatus.

DETAILED DESCRIPTION

Reference will now be made in detail to a preferred embodiment of the feeding apparatus disclosed in the present application, examples of which are also provided in the following description. Exemplary embodiments of the feeding apparatus disclosed in the present application are described in detail, although it will be apparent to those skilled in the relevant art that some features that are not particularly important to an understanding of the feeding apparatus may not be shown for the sake of clarity.

Furthermore, it should be understood that the feeding apparatus disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

Figure 1:
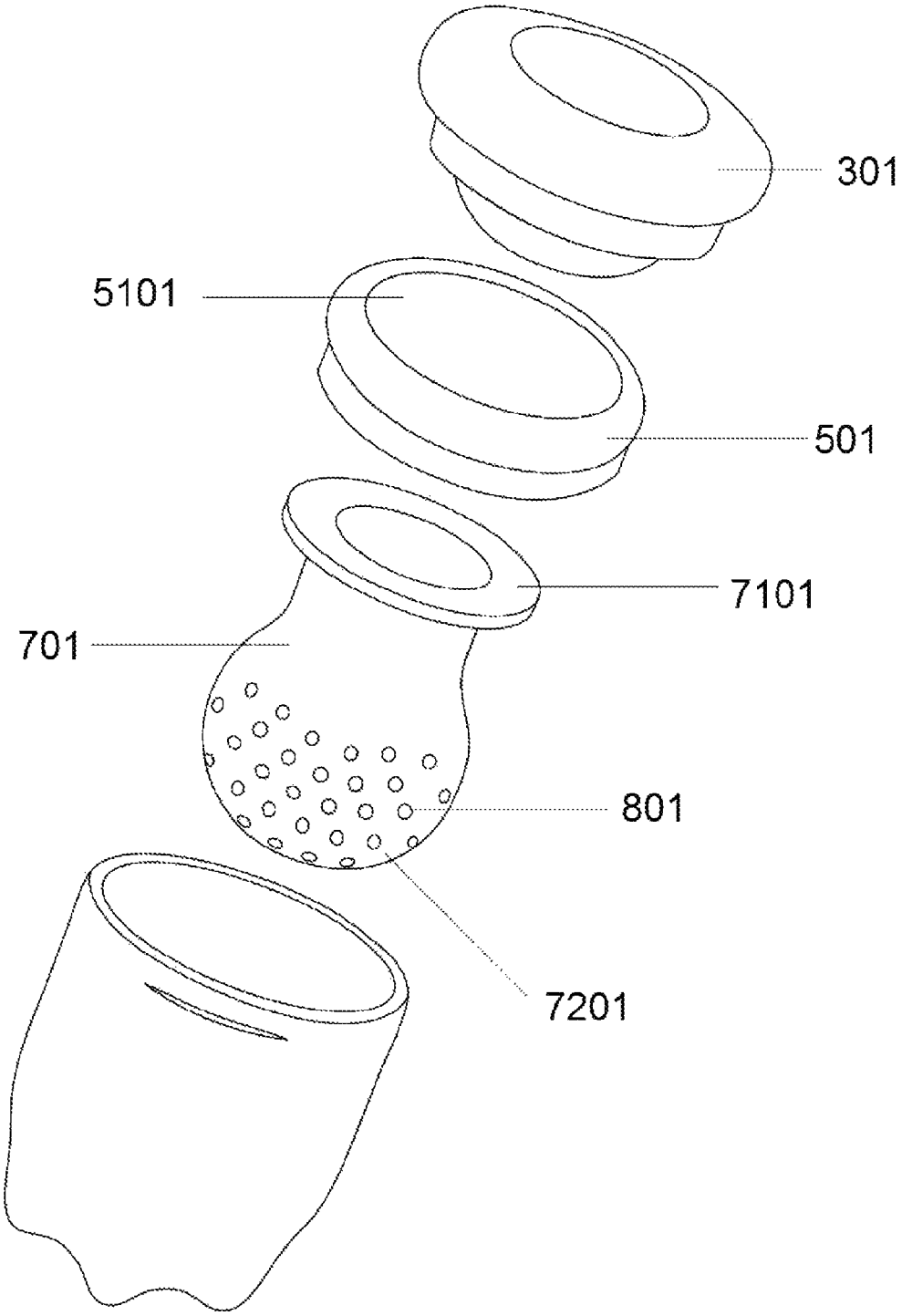
FIG. 1 is an exploded view of a first embodiment of the feeding apparatus.

FIG. 1 is an exploded view of a first embodiment of the feeding apparatus. The apparatus includes a food container 701, a first coupling member 501, and a second coupling member 301. The food container 701 has an open end 7101 and a closed end 7201. The first coupling member 501 includes an opening 5101. The food container 701 can be removably engaged with the first coupling member 501. When the food container 701 is coupled to the first coupling member 501, the open end 7101 of the food container 701 is in communication with the opening 5101 of the first coupling member 501. Food can be put into the food container 701 through the opening 5101 of the first coupling member and the open end 7101 of the food container 701. The second coupling member 301 can be cooperating with the first coupling member 501 and movable between an open configuration and a sealed configuration. In the open configuration, food can be put into the food container 701 through the opening 5101 of the first coupling member 501 and the open end 7101 of the food container 701. In the sealed configuration, the second coupling member 301 covers the opening 5101 of the first coupling member 501 thereby sealing the open end 7101 of the food container 701.

The food container 701 is provided with at least one aperture 801. According to the illustrated embodiment, the food container 701 has a plurality of apertures 801 arranged 360 degrees around the food container 701. The size and shape of the apertures 801 can be so designed that food coming out from the apertures 801 would not choke a person consuming the food. According to the illustrated embodiments, the apertures 801 are circular in shape and can have a diameter of about 1 mm to about 5 mm. The size, number and arrangement of the apertures 801 may vary according to different designs and requirements.

The food container 701 may be made of a soft resilient material suitable for use with foodstuff. This soft resilient material for foodstuff use may include silicone or latex, or rubber or polyvinyl chloride (PVC) for foodstuff use. Silicone material is non-toxic, environmental friendly, wear resistant, resistant to high and low temperatures, and aging resistant. Products made of silicone are more environmental-friendly, more safe and more durable. It is appreciated that the food container 701 can be made of a transparent soft resilient material allowing a person to readily see through the food container 701 and know whether the container 701 is full or empty.

Normally, the food container 701 stays in its original shape and the food stays inside the food container 701. When the food container 701 is put inside a person's mouth and a person chews, bites or sucks on the food container 701, the food container 701 collapses by the external force that forces the food (such as small pieces of crushed food, fruit puree, marc, juice, etc.) to seep and pass through the apertures 801. The food container 701 returns to its original shape upon release of the force due to the resiliency of the food container 701.

The food container 701 may be sized and shaped to hold small pieces of fruit or other food such as jelly, yogurt, vegetable, meat or fish, etc. The food container 701 can be put inside the mouth of a person for biting, sucking or chewing. For a fruit having juice and marc, fruit juice and small pieces of marc can be sucked through the apertures 801 and into a person's mouth, whilst larger pieces of marc remain inside the food container 701. Since the apertures 801 are smaller than the esophagus of a person eating the food, the person will not be choked by the food coming out from the apertures 801. This can protect the safety of the person eating food out of the feeding apparatus. For fruit having puree but without marc, the fruit puree can be dispensed through the apertures 801 and into the person's mouth. Therefore, one can use the feeding apparatus to feed an infant or baby with food such a fruit, and teach an infant or baby to chew and swallow without the risk of being choked by the fruit. The feeding apparatus is safe to an infant or baby and is convenient to use because it is not necessary for a caretaker to squeeze juice from the fruit before feeding. Using the feeding apparatus, an infant or baby can readily eat fresh fruit (such as strawberry, apple and pear), vegetable, fish, meat, etc.

When the food container 701 contains a mixture of food in solid state and liquid state, the liquid can form a sealing membrane over the apertures 801 under the influence of surface tension. Therefore, food inside the container 701 cannot be easily escaped through the apertures 801. An infant or baby needs to perform a suck action to suck the food through the apertures 801. This can train the muscles around the mouth as well as train the lung capacity of an infant or baby. Also, it can prevent leakage of liquid through the apertures 801 and spoilage of the clothing of the person eating the food out of the feeding apparatus. If the food container 701 is made of a mesh, the apertures on the mesh are not resilient and therefore it is difficult to form a sealing membrane over the apertures of the mesh. As the apertures on the mesh are close to each other, it becomes more difficult to form a sealing membrane over the mesh's apertures. The distance between two apertures 801 in the present application can be about 2 mm to about 10 mm.

As shown in FIG. 1, the first coupling member 501 and the second coupling member 301 may be coupled together. For example, the first coupling member 501 may be provided with an annular recess and the second coupling member 301 may be provided with an annular projection. A sealing configuration can be formed when the annular projection is pressed into the annular recess. An open configuration can be formed when the annular projection is pulled out from the annular recess. Of course, the first coupling member 5 and the second coupling member 301 can be coupled together by other suitable coupling mechanism such as screw threads.

Figure 2:
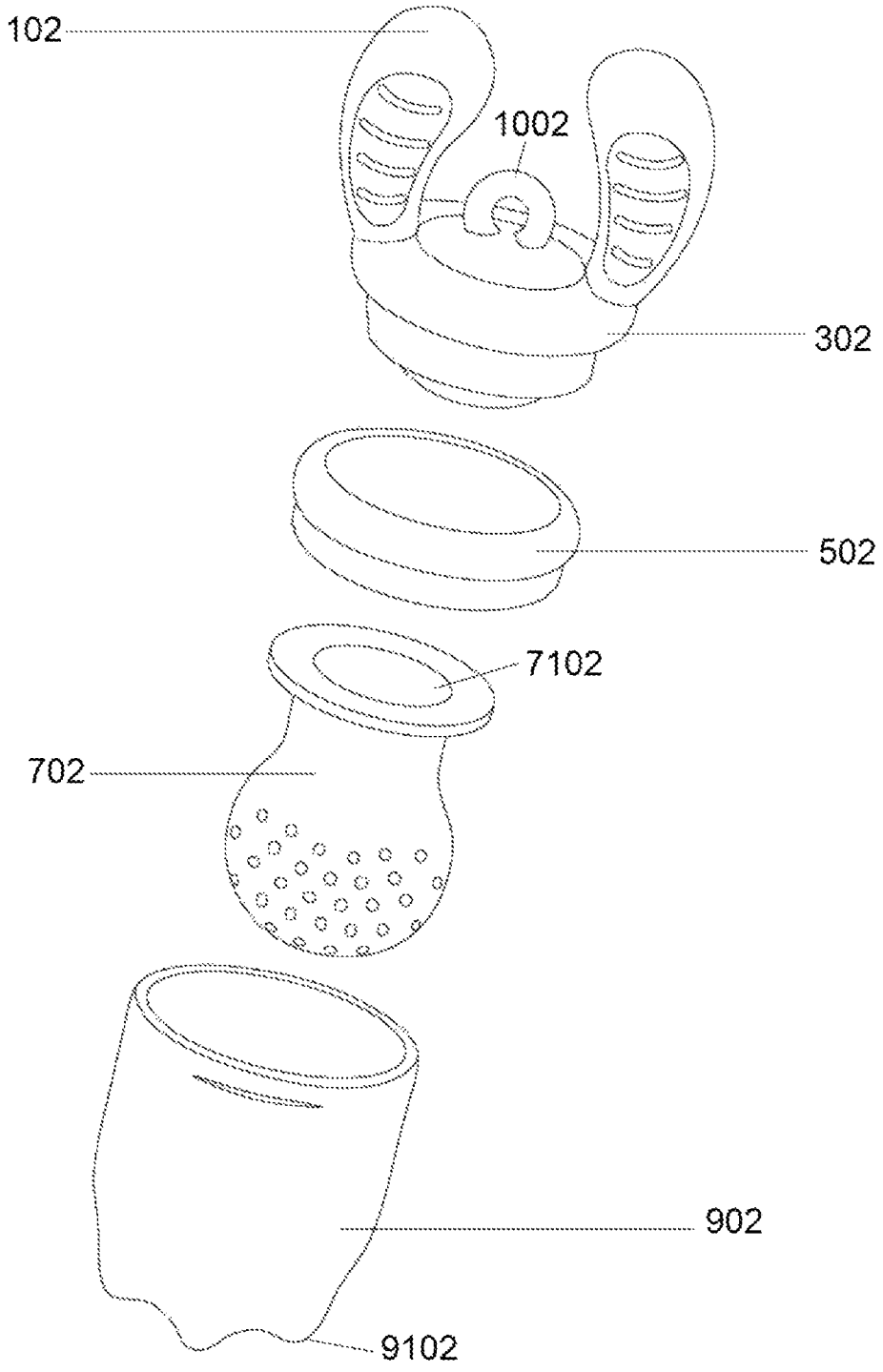
FIG. 2 is an exploded view of a second embodiment of the feeding apparatus.

As shown in FIG. 2, the feeding apparatus may further be provided with a handle assembly 102 which is connected to the second coupling member 302. This facilitates the grasping of the feeding apparatus by a person eating the food. This can promote the training of the muscles of the hands of a person, especially for babies and patients, and can promote his or her hand, brain and mouth coordination. This feeding apparatus design can realize the food-eating initiative of an infant or baby.

The feeding apparatus may also include a cap 902 for covering the food container 702. The cap 902 serves to separate the food from the outer environment. The cap 902 can prevent any dust and dirt from contaminating the food while a person is not eating. The cap 902 may be removably attached to the first coupling member 502. As shown in the illustrated embodiment, the cap 902 can be attached to the first coupling member 502 by a simple snap-fitting mechanism. It is understood that the cap 902 may be attached to the first coupling member 502 by any other appropriate mechanism such as screw threads. The closed end of the cap 902 may be provided with a plurality of supporting elements 9102. The supporting elements 9102 allow the cap 902 to steadily stand on a flat surface such as a desk. To fill the food container 702 with food, one can attach the cap 902 to the first coupling member 502, and then place the cap 902 on a desk in a stand-up position by the supporting elements 902.

This facilitates the filling of the food container 702 with food even with one hand. The cap 902 may also be transparent and allow one to see the food inside the food container 702.

As illustrated in FIG. 2, the feeding apparatus may be provided with a rope-attaching element 1002 by which a rope can be tied. The rope-attaching element 1002 may be generally in the form of a ring integrally formed on the second coupling member 302. The rope-attaching element 1002 may be made of a hard plastic material or any other suitable material. A rope can be tied or threaded through the rope-attaching element 1002 so that the feeding apparatus can be hung around a person. This prevents the feeding apparatus from accidentally dropping on the ground and contaminating the food.

The food container 702 may be formed into the shape of a nipple of a milk-feeding bottle. It serves as a pacifier to comfort an infant or baby and induces the infant or baby to eat the food. The closed end of the food container 702 may be formed into a shape substantially conforming to the shape of the mouth of an infant or baby. This facilitates the infant in holding the food container 702 inside the mouth, and sucking fruit juice, puree or marc out of the food container 702 without choking.

According to the illustrated embodiment, the open end 7102 of the food container 702, the outer surfaces of the first coupling member 502 and the second coupling member 302 are generally circular in shape. This prevents the trapping of dirt on the feeding apparatus and facilitates cleaning of the feeding apparatus.

The feeding apparatus may also be provided with a fastening mechanism for fastening the first and second coupling members 502, 302 of the feeding apparatus in the sealed configuration. The fastening mechanism can strengthen the sealing between the first and second coupling members 502, 302 and prevent accidentally detaching the first coupling member 502 from the second coupling member 302 and therefore dropping the food.

Figure 3:
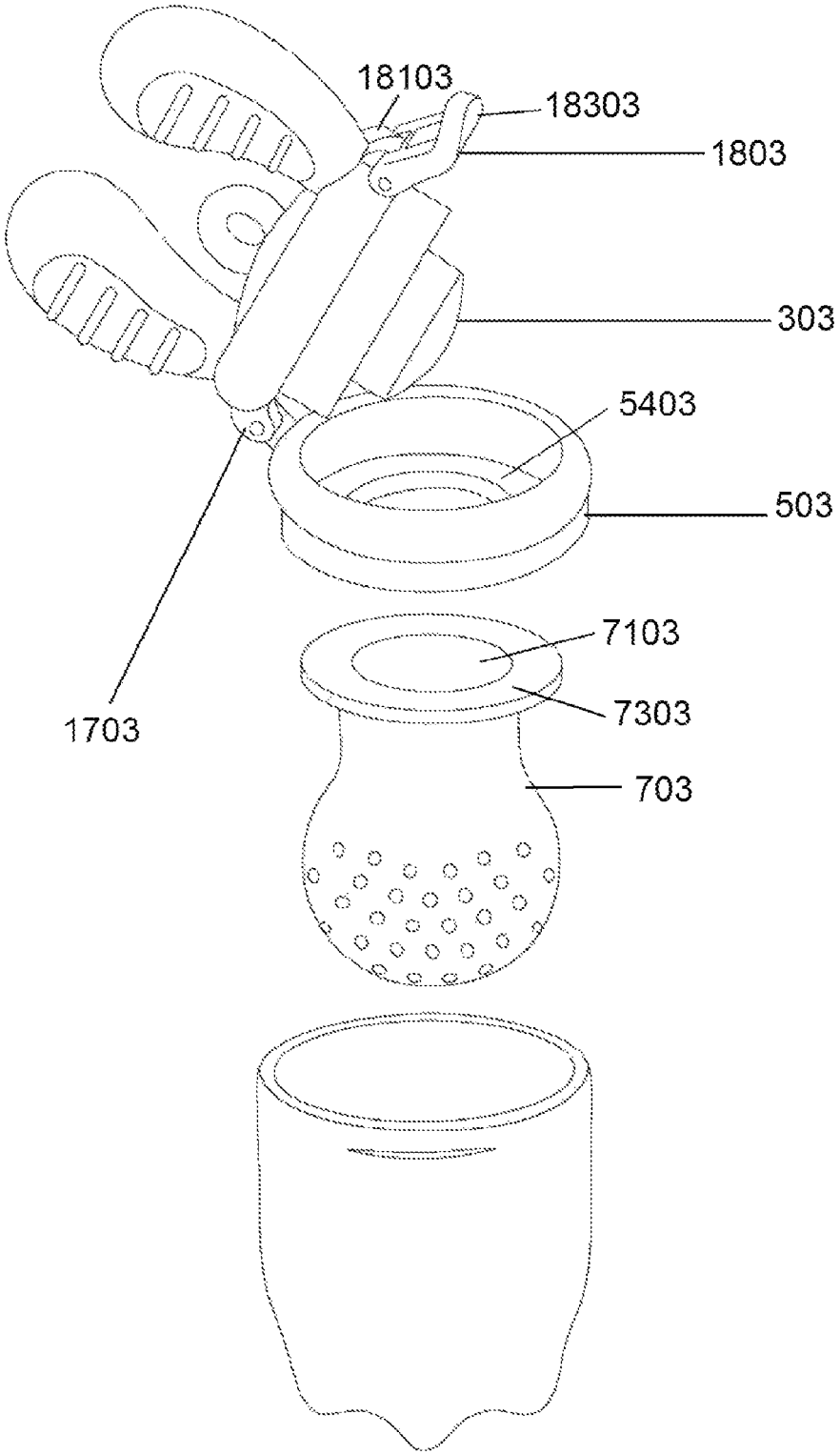
FIG. 3 is an exploded view of a third embodiment of the feeding apparatus.
Figure 4:
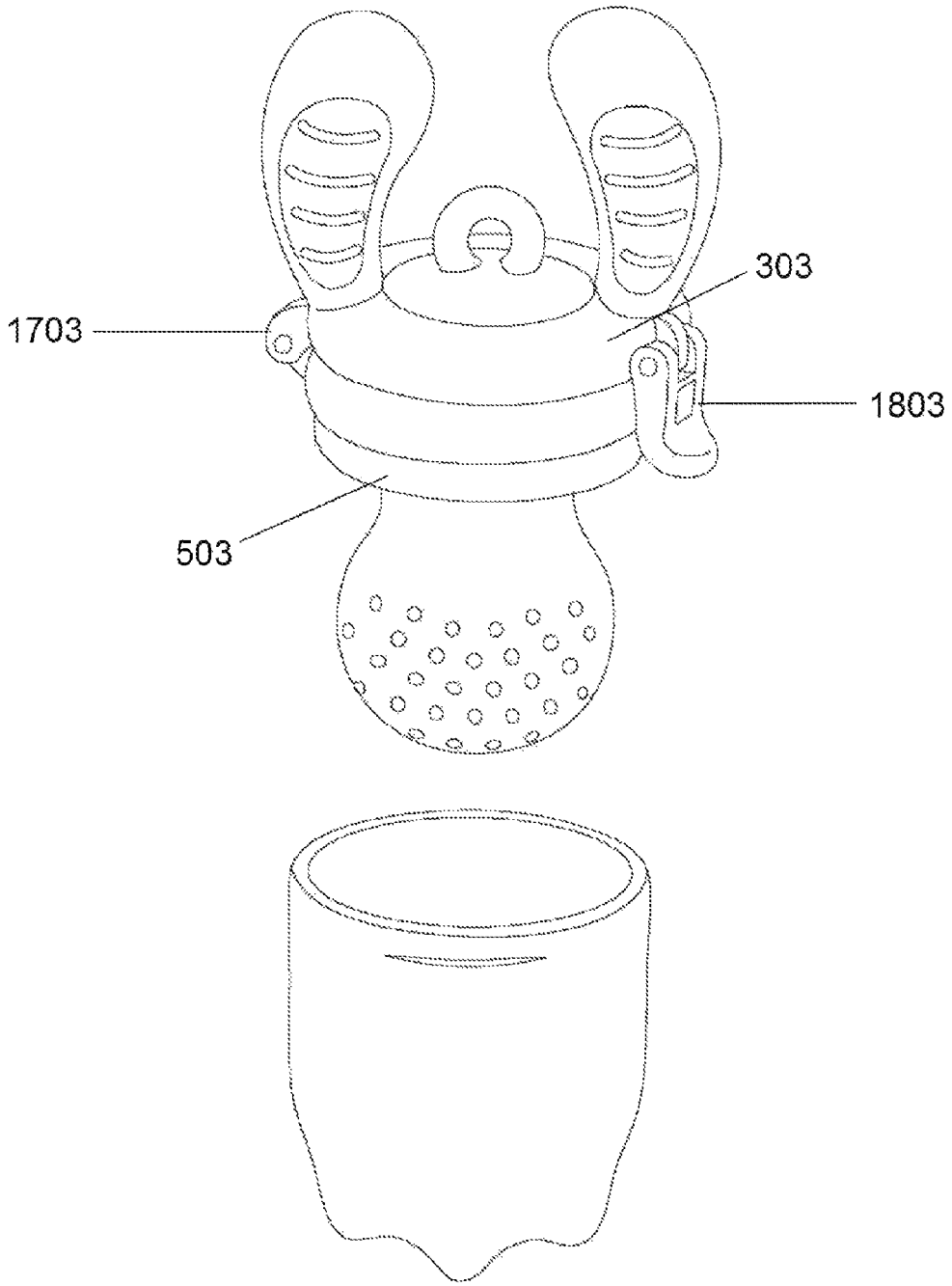
FIG. 4 is a perspective view of the third embodiment of the feeding apparatus.

According to the illustrated embodiment in FIGS. 3 and 4, the fastening mechanism may include a hinge 1703 and a fastener 1803. One side of the first and second coupling members 503, 303 can be hingedly connected to each other by the hinge 1703. The other side of the first and second coupling members 503, 303 can be secured together by the fastening 1803. One end 18103 of the fastener 1803 can be movably connected to the second coupling member 303. The other end 18303 of the fastener 1803 may include a fastening hole for frictional engagement with a corresponding fastening projection integrally formed on the first coupling member 503. It is contemplated that the hinge 1703 and the fastener 1803 are simple in construction, and can make opening and closing of the first and second coupling members 503, 303 easy.

Figure 5:
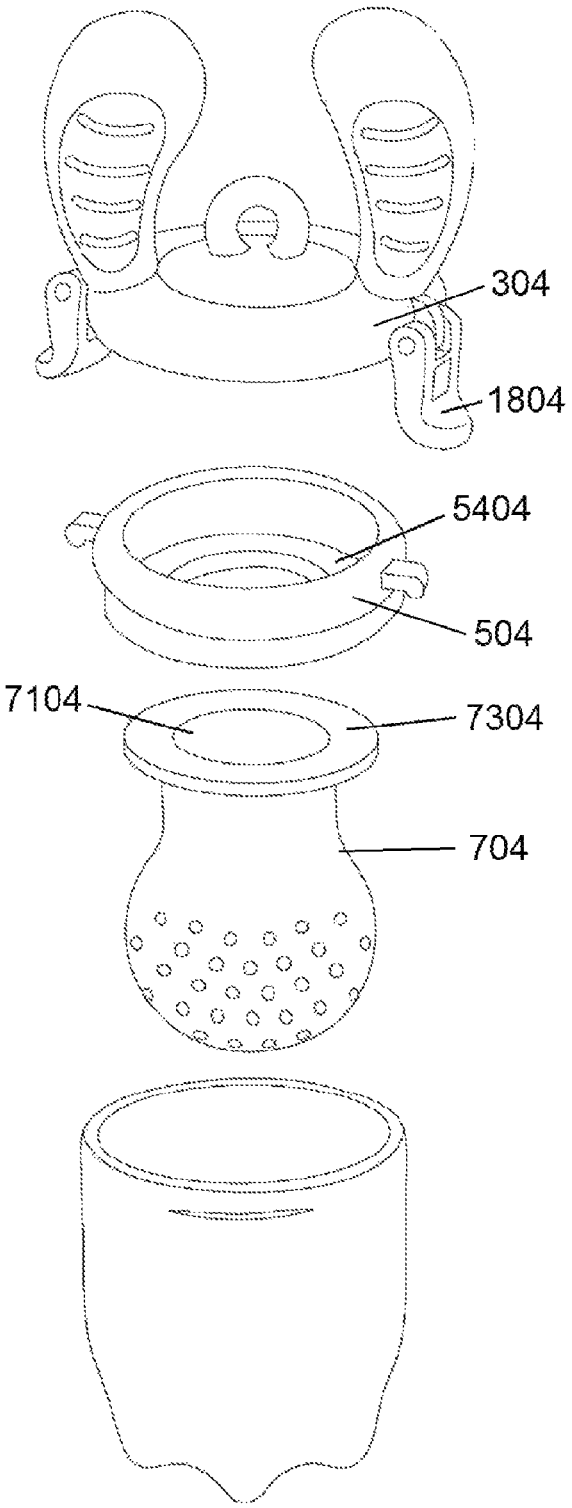
FIG. 5 is a partially exploded view of a fourth embodiment of the feeding apparatus.
Figure 6:
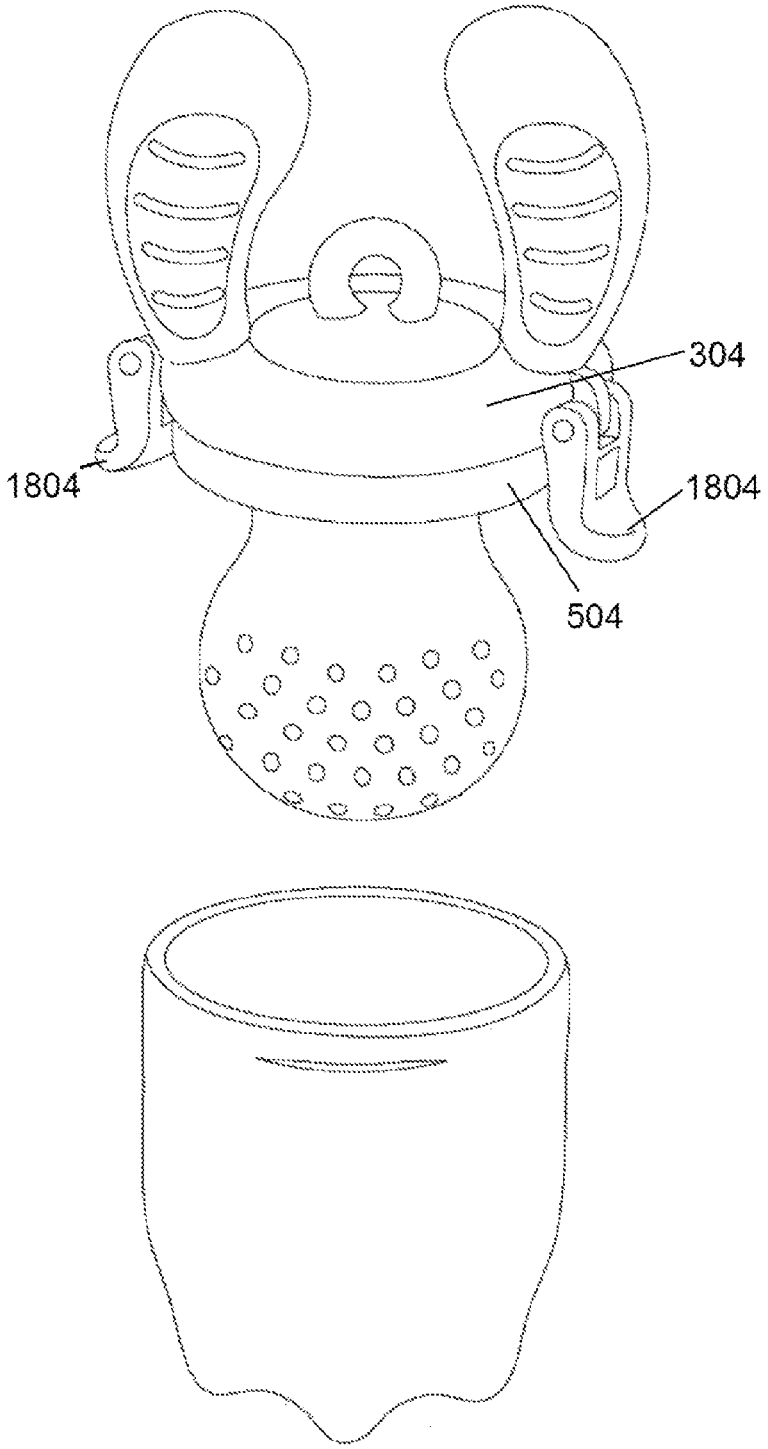
FIG. 6 is a perspective view of the fourth embodiment of the feeding apparatus.
Figures 7, 7A, 7B:
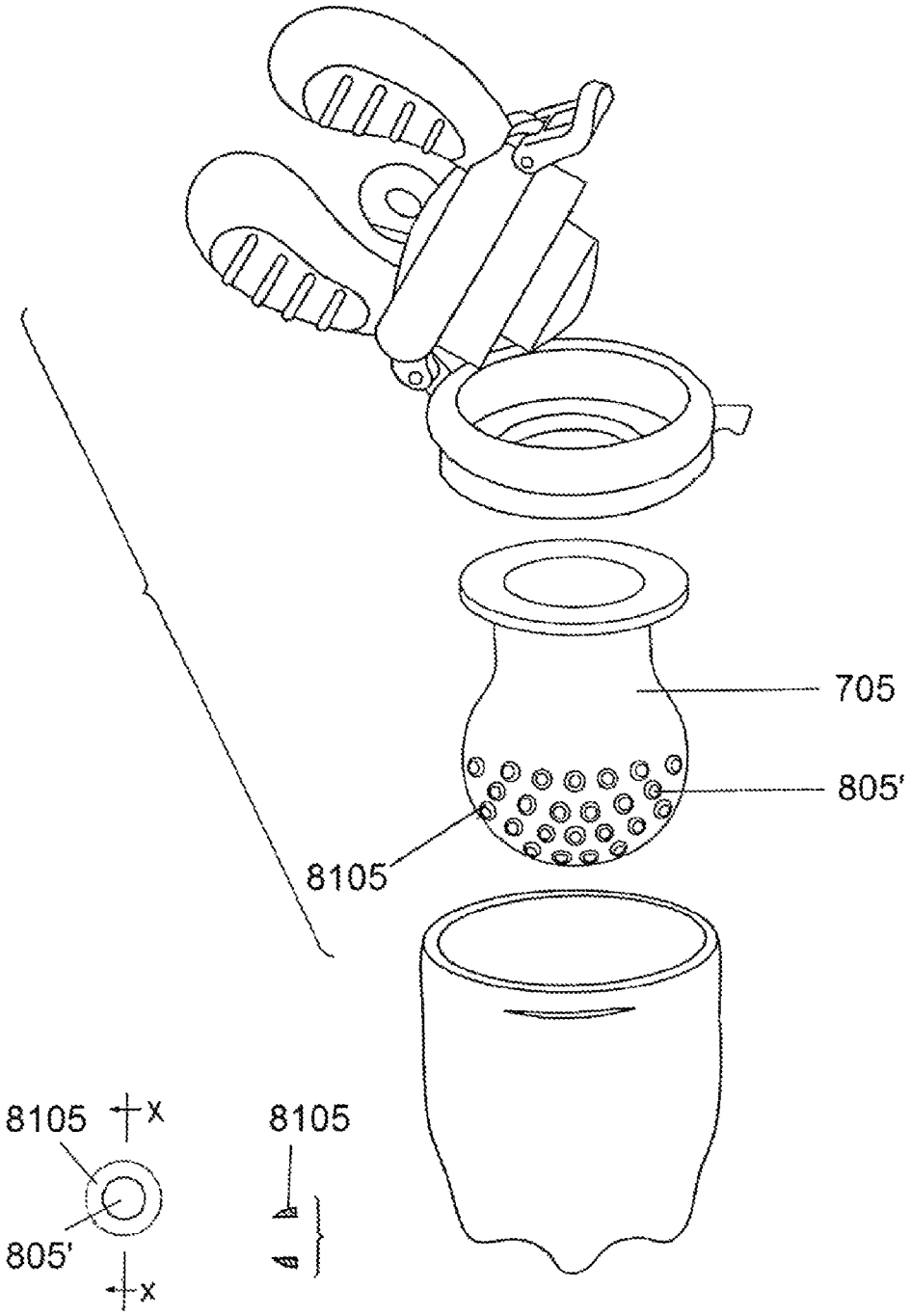
FIG. 7 is a partially exploded view of a fifth embodiment of the feeding apparatus.
Figure 8:
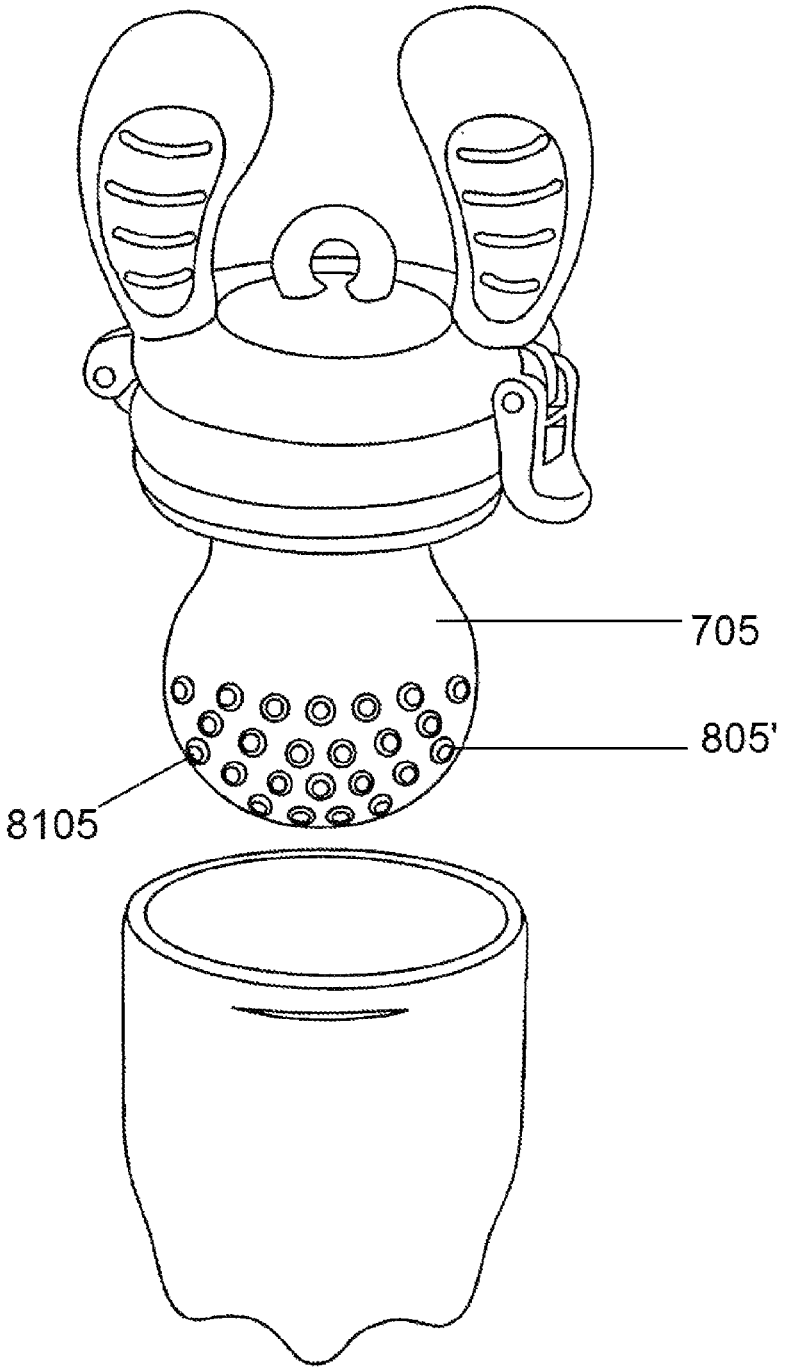
FIG. 8 is a perspective view of the fifth embodiment of the feeding apparatus.

According to another embodiment illustrated in FIGS. 5 and 6, the fastening mechanism may include two fasteners 1804. The two sides of the first and second coupling members 504, 304 can be secured together by the two fasteners 1804 respectively.

As depicted in FIGS. 7, 7*a*, 7*b* and 8, an annular protrusion 8105 may be integrally formed on the outer surface around of the aperture 805'. The protrusion 8105 can be used to massage the gum, relief discomfort during teething, benefit the growth and development of gum and teeth of an infant or baby. The protrusions 8105 can also strengthen the gum and enhance chewing capability. One can put an infant or baby's favorite food inside the food container 705. Infant or baby would like to eat the food and have the gum massaged while eating the food. The feeding apparatus with protrusions 8105 can therefore serve as a more effective teether compared to conventional tasteless teething apparatus.

Figure 9:
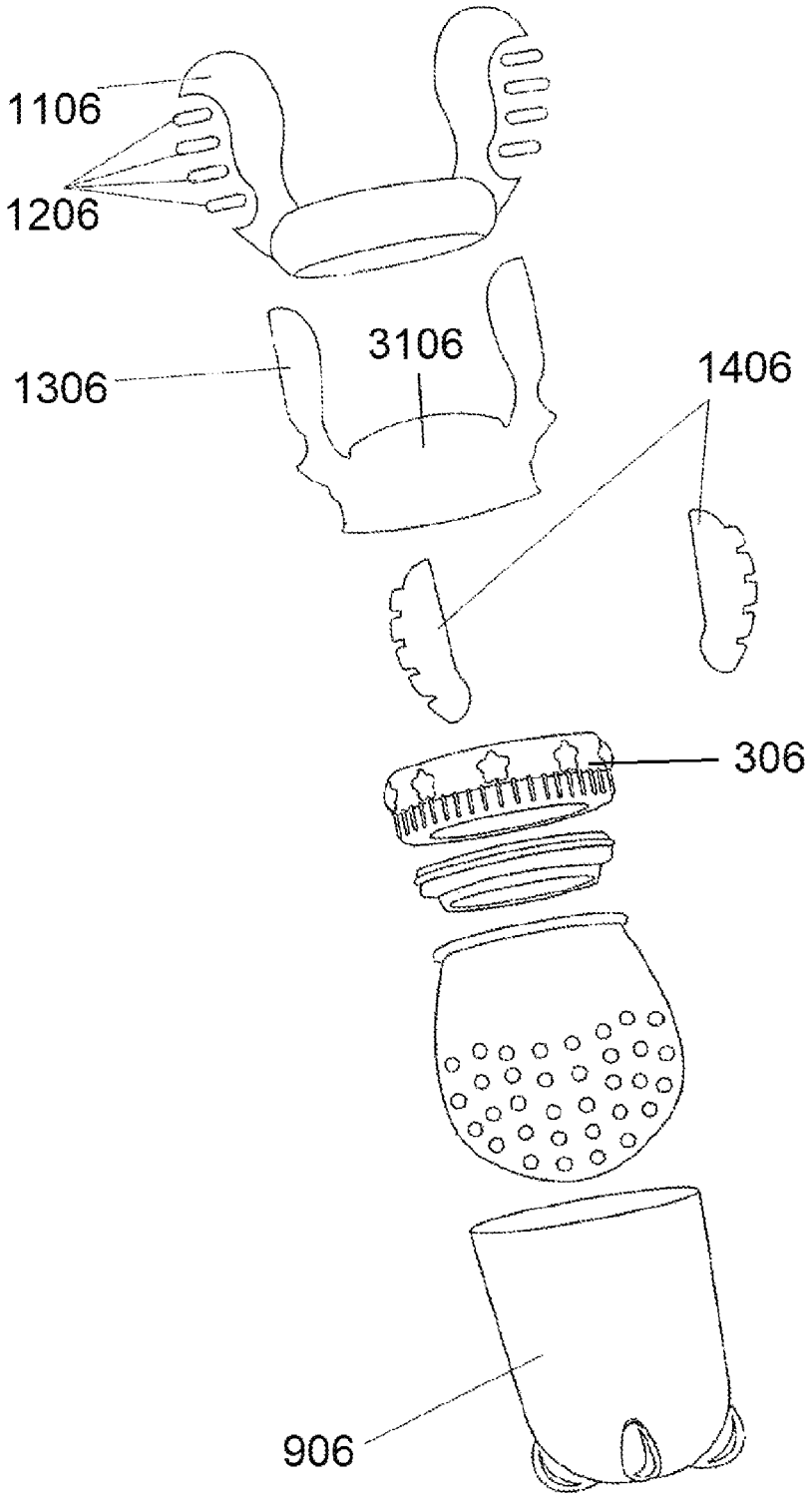
FIG. 9 is a partially exploded view of a sixth embodiment of the feeding apparatus.
Figure 10:
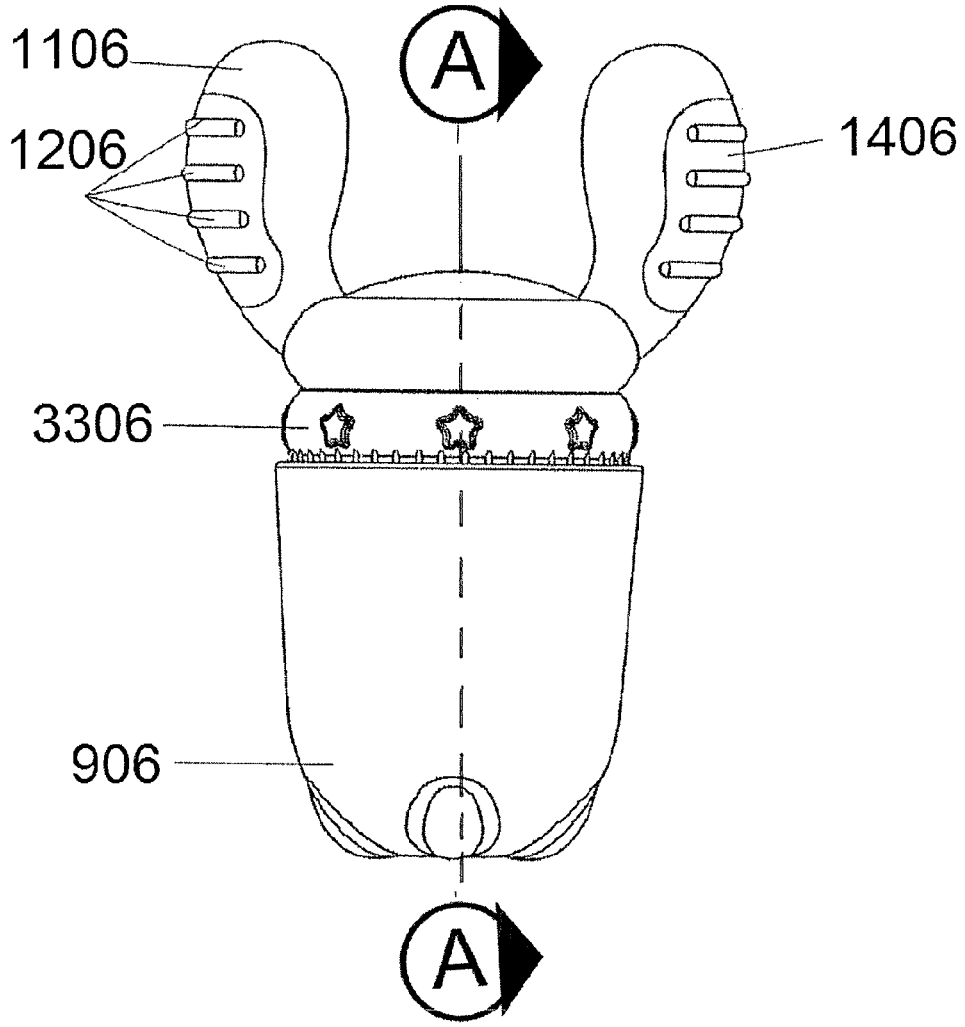
FIG. 10 is a side view of the sixth embodiment of the feeding apparatus.

The feed apparatus of the present application may include one handle assembly or two handle assemblies. As shown in FIGS. 9 and 10, the handle assembly of the feeding apparatus may include a handle core 1306, a handle pad 1406 and a handle sleeve 1106. The handle core 1306 can be attached to the second coupling member 306. The handle pad 1406 can be fixed on the handle core 1306 to provide anti-slip and appealing effects. According to the illustrated embodiment, two handle pads 1406 are attached to the front and the back of the handle core 1306 respectively. Alternatively, the two handle pads 1406 may be attached to the left side and the right side of the handle core 1306 respectively. The handle sleeve 1106 can be wrapped around the handle pad 1406. The handle assembly may further include a plurality of anti-slip strips 1206. The strips 1206 may be secured onto the handle pads 1406 to further provide anti-slip and appealing effects. It is understood that the number of strips 1206 on a handle pad 1406 may vary depending on the different designs. The handle sleeve 1106 and the strips 1206 may be made of soft rubber or any other suitable material, which can facilitate the gripping of the handle assembly and produce a comfort feeling to a person holding the handle assembly. The handle core 1306 and the handle pad 1406 may be made of hard plastic or any other suitable material.

Figure 11:
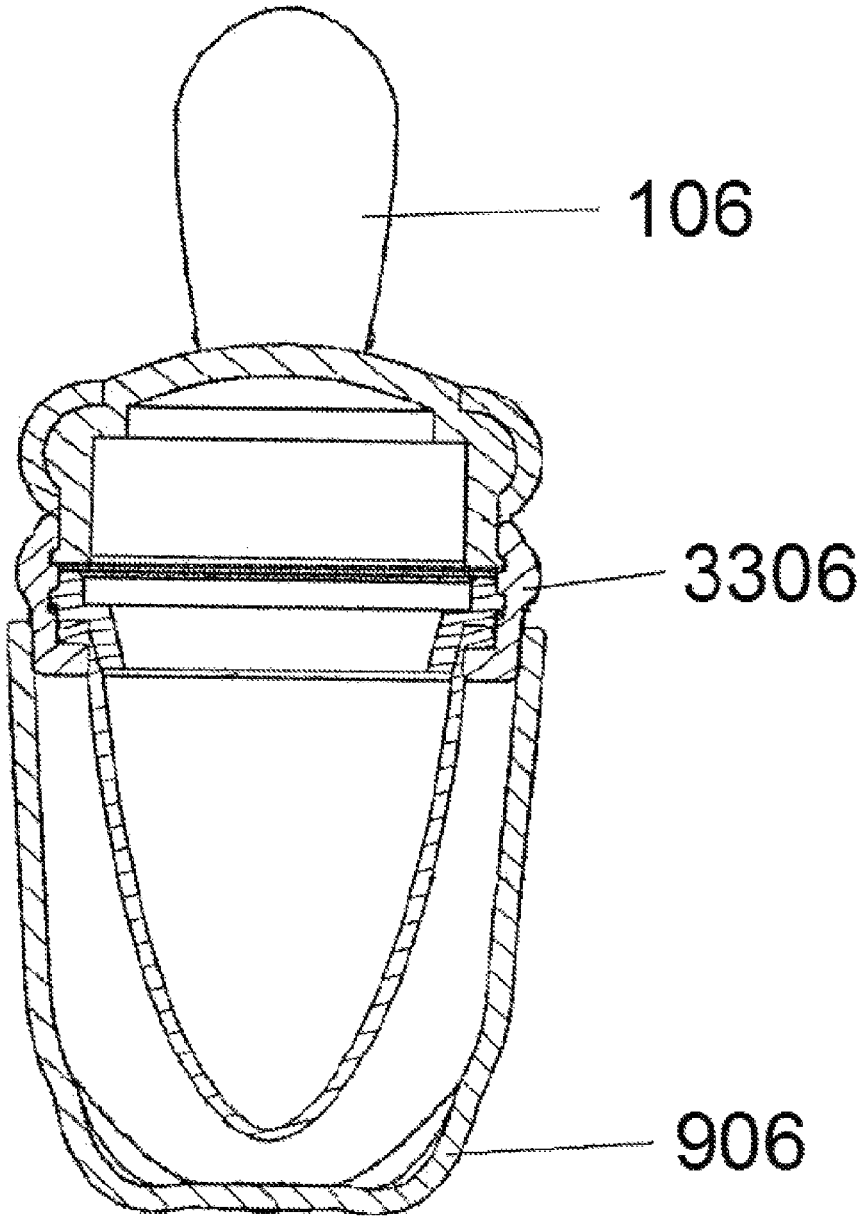
FIG. 11 is a cross sectional view taken along line A-A of the feeding apparatus in FIG. 10.

As shown in FIGS. 9-11, the second coupling member may include an outer ring 3306 and a cover 3106 covering the top of the outer ring 3306. The outer ring 3306 and the cover 3106 may be coupled together by relative rotation of a projection and recess mechanism. For example, the projection and recess mechanism may include an annular groove and an annular projection formed on the outer ring 3306 and the cover 3106 respectively. The outer ring 3306 and the cover 3106 may also be coupled together by screw threads. Alternatively, the outer ring 3306 and the cover 3106 may be integrally formed as one single piece. Two handle cores 1306 may be attached to the two sides of the cover 3106 respectively. Furthermore, the cap 906 can be coupled to the outer ring 3306.

As shown in the embodiment in FIGS. 3 and 5, a radially outwardly extending annular flange 7303, 7304 is provided at the open end 7103, 7104 of the food container 703, 704. In the sealed configuration, the annular flange 7303, 7304 rests on a radially inwardly extending annular shoulder or platform 5403, 5404 of the first coupling member 503, 504, and can be clamped between the annular platform 5403, 5404 and the second coupling member 303, 304. In the open configuration, the annular flange 7303, 7304 can be removed from the annular platform 5403, 5404 of the first coupling member 503, 504. This can make the assembling and cleaning of the feeding apparatus simple and easy. Since the food container 703, 704 is made of a soft resilient material, the soft resilient annular flange 7303, 7304 can have a sealing function and can strengthen the sealing between the first and the second coupling members 503, 504, 303, 304. This can further prevent the spilling of food while a person, especially a baby, is playing with the feeding apparatus while eating.

Figure 12:
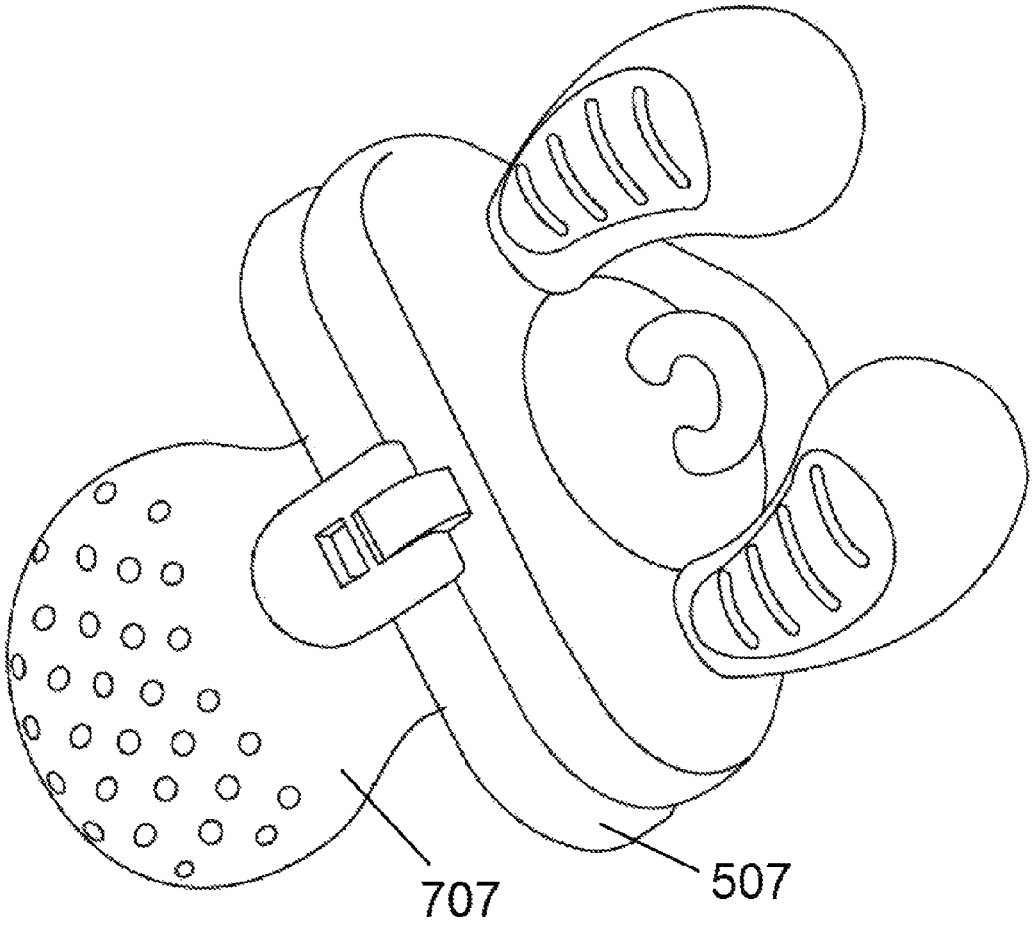
FIG. 12 is a perspective view of the seventh embodiment of the feeding apparatus.
Figure 13:
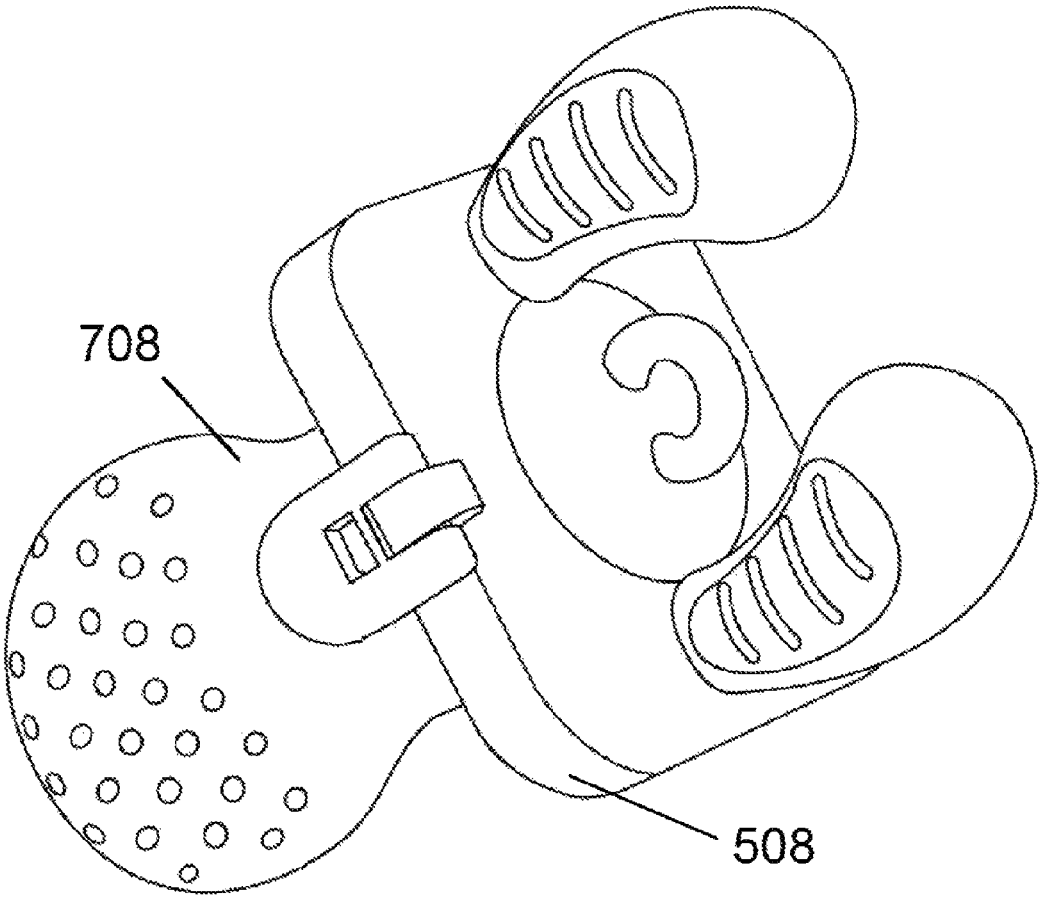
FIG. 13 is a perspective view of the eighth embodiment of the feeding apparatus.

As shown in FIG. 12, the open end of the food container 707 and the first coupling member 507 can be generally triangular in shape. Each of the three acute angles can be rounded. As shown in FIG. 13, the open end of the food container 708 and the first coupling member 508 can be generally rectangular in shape. Each of the angles can be rounded. These two feeding apparatus designs do not have unhygienic dead corners that would cause hygiene problem and are therefore easy to clean.

Figure 14:
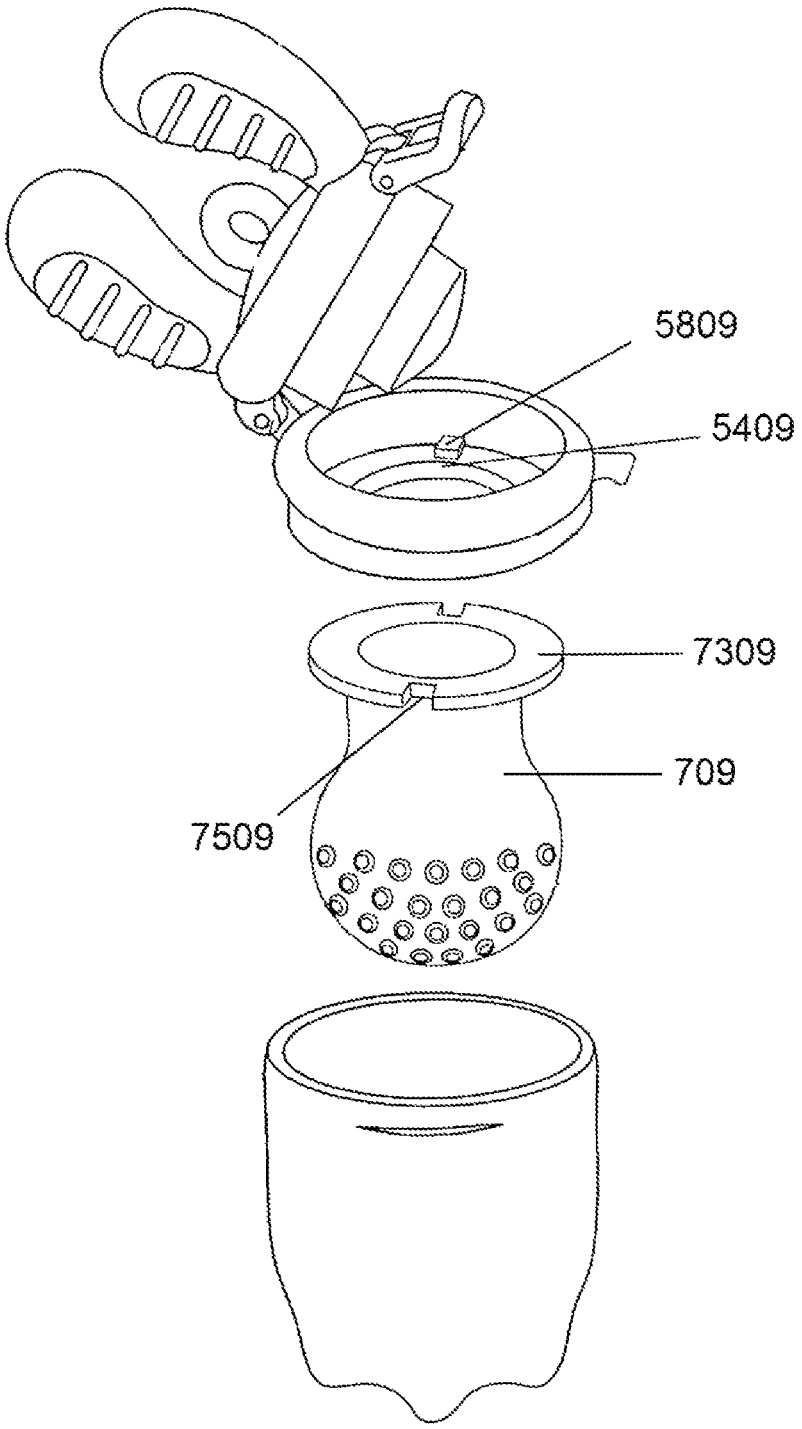
FIG. 14 is a partially exploded view of the ninth embodiment of the feeding apparatus.
Figure 15:
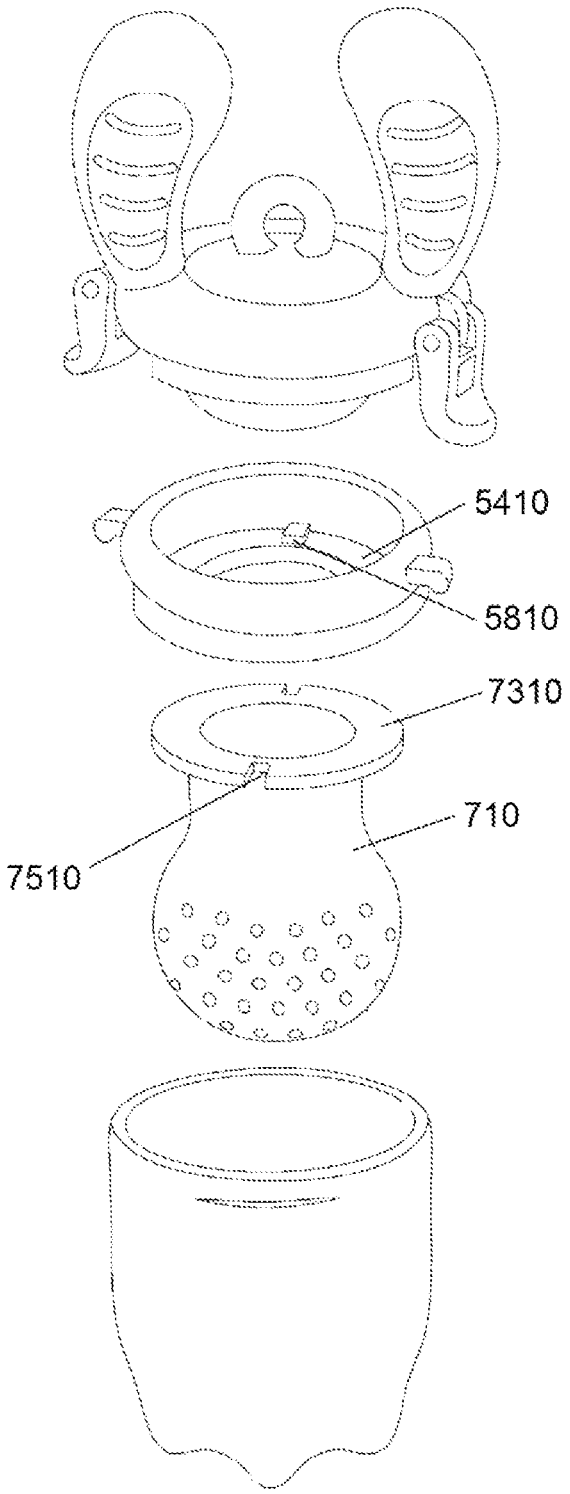
FIG. 15 is a partially exploded view of the tenth embodiment of the feeding apparatus.

As depicted in FIGS. 14 and 15, the position of the annular flange 7309, 7310 and the annular platform 5409, 5410 can be fixed by position-fixing mechanism thereby allowing a person to hold the handle by a hand in a horizontal position while the food container 709, 710 is in the mouth. This allows the person to hold the handle comfortably while eating. According to the illustrated embodiment, the position-fixing mechanism may include a notch 7509, 7510 provided on the annular flange 7309, 7310 and a corresponding projection 5809, 5810 provided on the annular platform 5409, 5410. Of course, it is appreciated that a notch can be formed on the annular platform 5409, 5410 and a corresponding projection can be formed on the annular flange 7309, 7310 instead.

Figure 17:
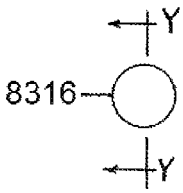
FIG. 17 is a top plan view of a projection provided on the food container in FIG. 16.
Figure 18:
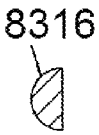
FIG. 18 is a cross sectional view taken along line Y-Y of the projection in FIG. 17.
Figure 16:
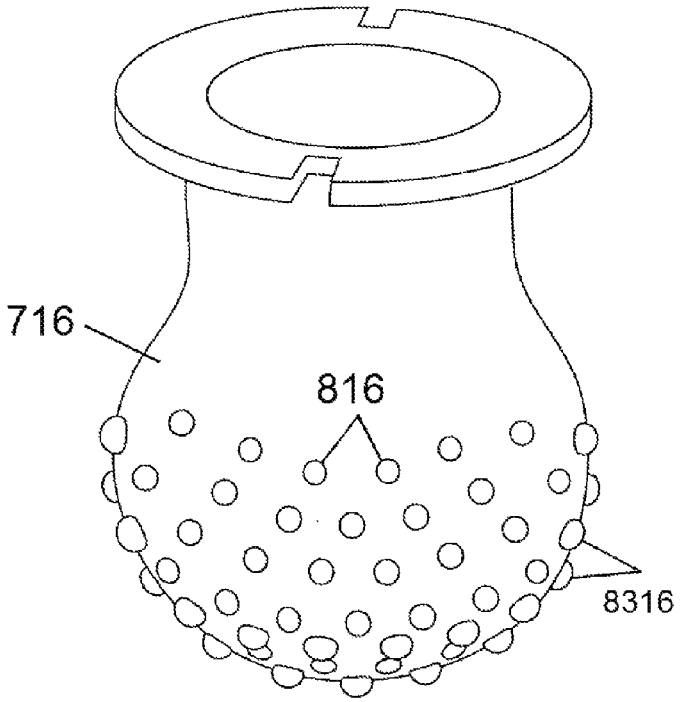
FIG. 16 is a perspective view of a food container of the eleventh embodiment of the feeding apparatus.

Although it has been shown and described that the annular protrusions 8105 are formed around the apertures 805', it is understood by one skilled in the art that further protrusions can be formed elsewhere on the outer surface of the food container 705. FIG. 16 shows a food container 716 having a plurality of apertures 816 formed around the food container 716 and a plurality of protrusions 8316 integrally formed at the closed end of the food container 716. The apertures 816 are used for dispensing food and the protrusions 8316 are used for massaging the gum of a baby or infant. According to the illustrated embodiment as shown in FIGS. 17 and 18, the protrusions 8316 are in the shape of a semi-circle. It is understood that the shape, size, and arrangement of these protrusions 8316 on the food container 716 may vary depending on different designs.

Although it has been shown and described that the apertures 816 and 805' are circular in shape, it is understood that the apertures 816 and 805' may in any other appropriate shapes.

As shown in FIGS. 17-21, the feeding apparatus may include a food container 7, a first coupling member 5, and a second coupling member 3. The food container 7 has an open end 71 and a closed end 72. The first coupling member 5 includes an opening 51. The food container 7 can be detachably coupled to the first coupling member 5. When the food container 7 is coupled to the first coupling member 5, the open end 71 of the food container 7 is in communication with the opening 51 of the first coupling member 5. Food can be put into the food container 7 through the opening 51 of the first coupling member 5 and the open end 71 of the food container 7. The second coupling member 3 can be cooperating with the first coupling member 5 and movable between an open configuration and a sealed configuration. In the open configuration, food can be put into the food container 7 through the opening 51 of the first coupling member 5 and the open end 71 of the food container 7. In the sealed configuration, the second coupling member 3 covers the opening 51 of the first coupling member 5 thereby sealing the open end 71 of the food container 7.

The food container 7 is provided with a plurality of apertures 8. According to the illustrated embodiment, the food container 7 has a plurality of apertures 8 arranged around the food container 7.

The second coupling member 3 may include a body 36 and a food-squeezing unit 35. The body 36 can be coupled to the first coupling member 5. The body 36 defines a passage 361. The food-squeezing unit 35 may be mounted to the body 36. The food-squeezing unit 35 has a second opening 351 at one end thereof. The food-squeezing unit 35 is employed to squeeze the food therein towards and into the food container 7 through the second opening 351, the passage 361 on the body 36, the opening 51 of the first coupling member 5, and the open end 71 of the food container 7.

Since the second coupling member 3 can be separated into body 36 and food-squeezing unit 35, one can manufacture a larger food-squeezing unit 35. When the food in the food container 7 is consumed, the user (including a parent or an infant) can squeeze the food out of the food-squeezing unit 35 and towards and into the food container 7, and continue the feeding process. This facilitates outdoor feeding and enhances the joy of food taking.

The food-squeezing unit 35 may be in the form of a squeezable container for squeezing out the food therefrom when the external surface of the food-squeezing unit 35 is pressed. When the food-squeezing unit 35 is pressed, the food inside passes through the second opening 351 of the food-squeezing unit 35, the passage 361 of the body 36, the opening 51 of the first coupling member 5, the open end 71 of the food container 7 and into the food container 7. The food-squeezing unit 35 may be made of a resilient material for use with foodstuff. The resilient material may comprise silicone, latex or rubber for use with foodstuff.

One side of the body 36 can be connected to the first coupling member 5 by a hinge 17, and the other side of the body 36 can be detachably connected to the first coupling member 5 by fastener 18. The open end 71 of the food container 7, the first coupling member 5, the body 36 of the second coupling member 3, the second opening 351 of the food-squeezing unit 35 can have a circular outer configuration so that the feeding apparatus is easy to clean because it has no unhygienic dead corners.

Figure 19:
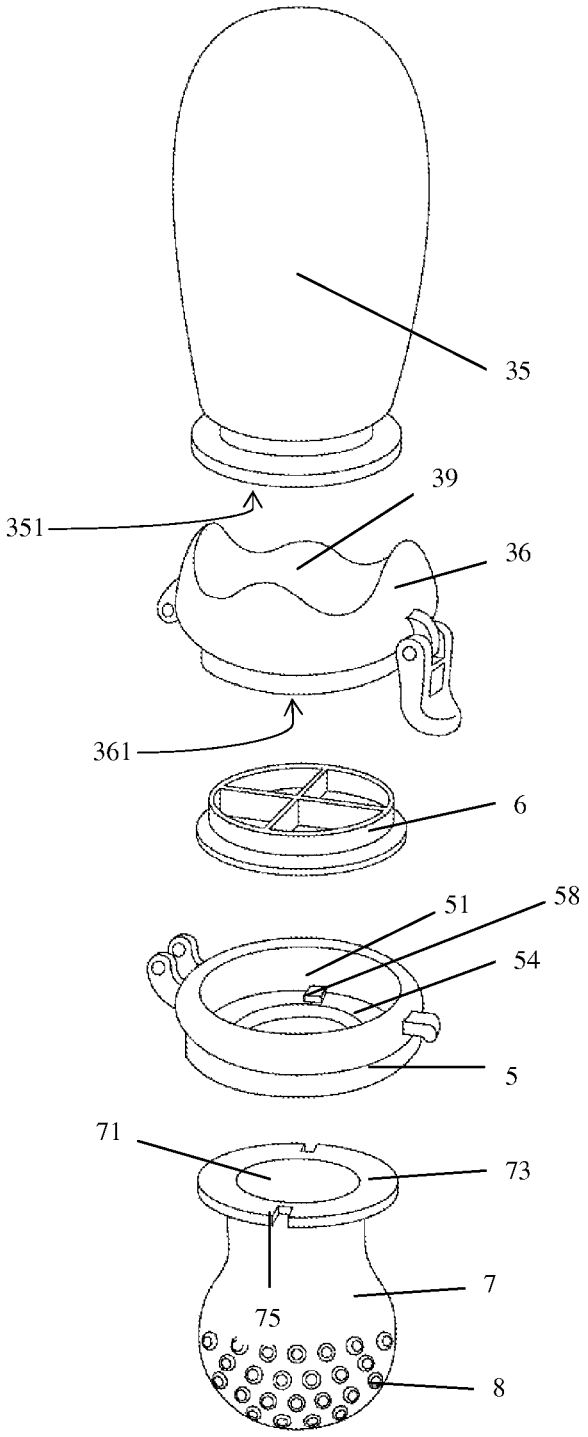
FIG. 19 is a partially exploded view of the twelfth embodiment of the feeding apparatus.
Figure 21:
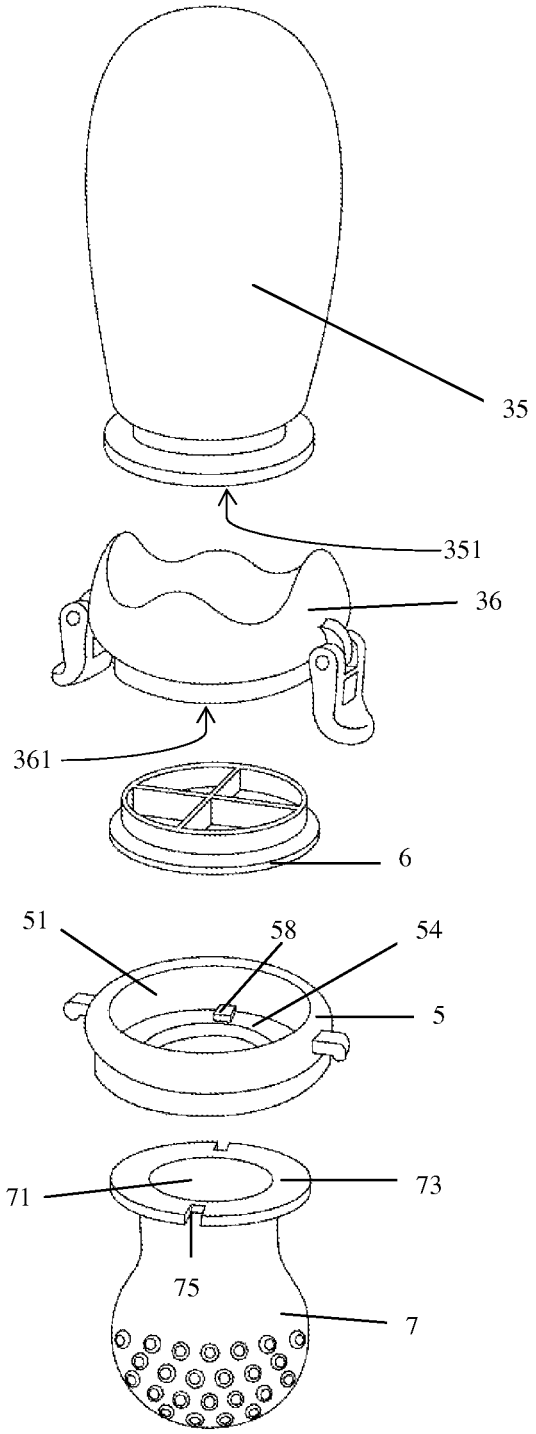
FIG. 21 is a partially exploded view of the thirteenth embodiment of the feeding apparatus.
Figure 26:
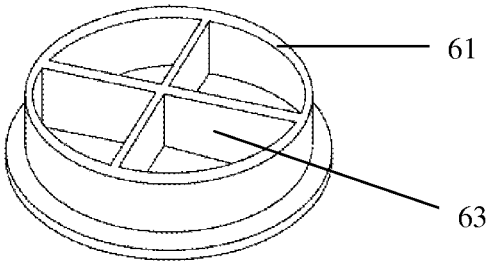
FIG. 26 is a perspective view of the intermediate member of the thirteenth embodiment of the feeding apparatus.

As illustrated in FIGS. 19 and 21, the feeding apparatus may include an intermediate member 6 located between the body 36 and the first coupling member 5. The intermediate member 6 is employed to prevent the food inside the food container 7 from moving back into the food-squeezing unit 35. According to the embodiments illustrated in FIG. 26, the intermediate member 6 may include a casing 61 and two blocking plates 63. The casing 61 defines a central space in which the two blocking plates 63 are formed into the shape of a cross. The two blocking plates 63 serve to block the food inside the food container 7 thereby preventing the food from moving back into the food-squeezing unit 35. However, it is contemplated that when the food-squeezing unit 35 is pressed, the pressure inside the food-squeezing unit 35 increases and forces the food inside the food-squeezing unit 35 to move towards and into the food container 7.

It is understood that the number of blocking plates 63 may vary according to the requirements.

Figure 27:
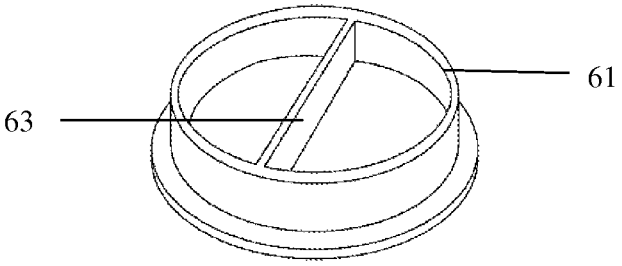
FIG. 27 is a perspective view of another intermediate member of the thirteenth embodiment of the feeding apparatus.
Figure 28:
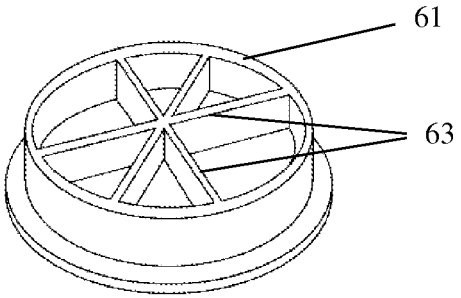
FIG. 28 is a perspective view of yet another intermediate member of the thirteenth embodiment of the feeding apparatus.

For example, in FIG. 27, there is only one blocking plate 63 extending across a center of the casing 61. As illustrated in FIG. 28, there are three blocking plates 63 formed into the shape of an asterisk.

Figure 20:
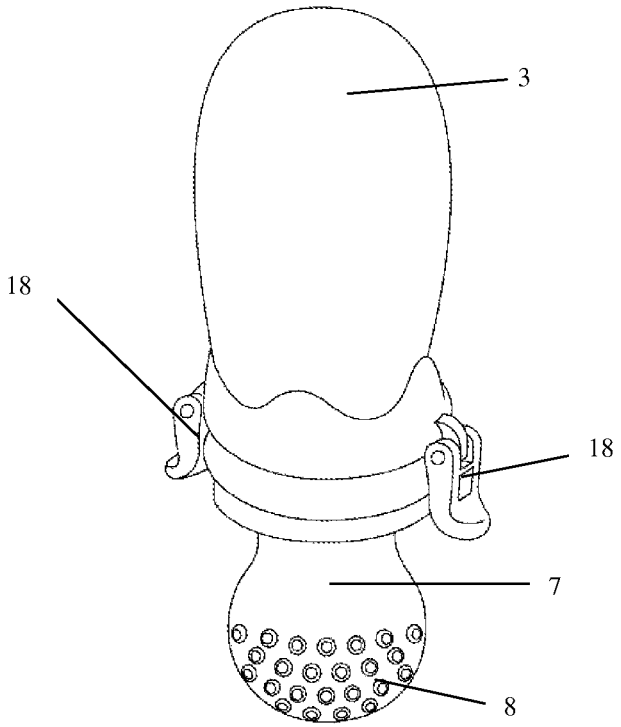
FIG. 20 is a perspective view of the thirteenth embodiment of the feeding apparatus.

As depicted in a further embodiment in FIG. 20, one side of the body 36 is connected to the first coupling member 5 by one fastener 18, and the other side of the body 36 is detachably connected to the first coupling member 5 by another fastener 18.

According to the illustrated embodiments in FIGS. 17-21, the feeding apparatus may include a position-fixing mechanism. The position of the annular flange 73 of the food container 7 relative to the annular platform 54 of the first coupling member 5 can be fixed by the position-fixing mechanism. This allows a person to hold the food-squeezing unit 35 in a horizontal position while the food container 7 is in the mouth. This allows the person to hold the handle comfortably while eating. The position-fixing mechanism may include a notch 75 provided on the annular flange 73 and a corresponding projection 58 provided on the annular platform 54. Of course, it is appreciated that a notch can be formed on the annular platform 54 and a corresponding projection can be formed on the annular flange 73 instead.

Figure 22:
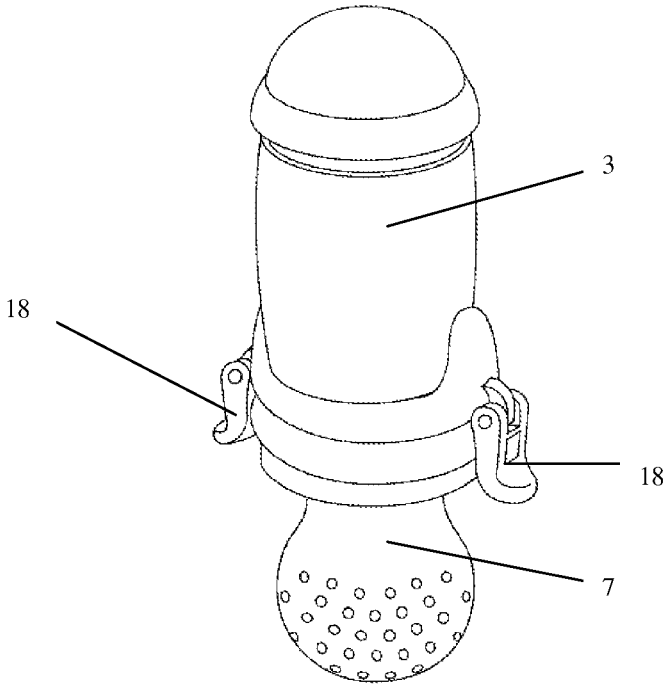
FIG. 22 is a perspective view of the fourteenth embodiment of the feeding apparatus.
Figure 23:
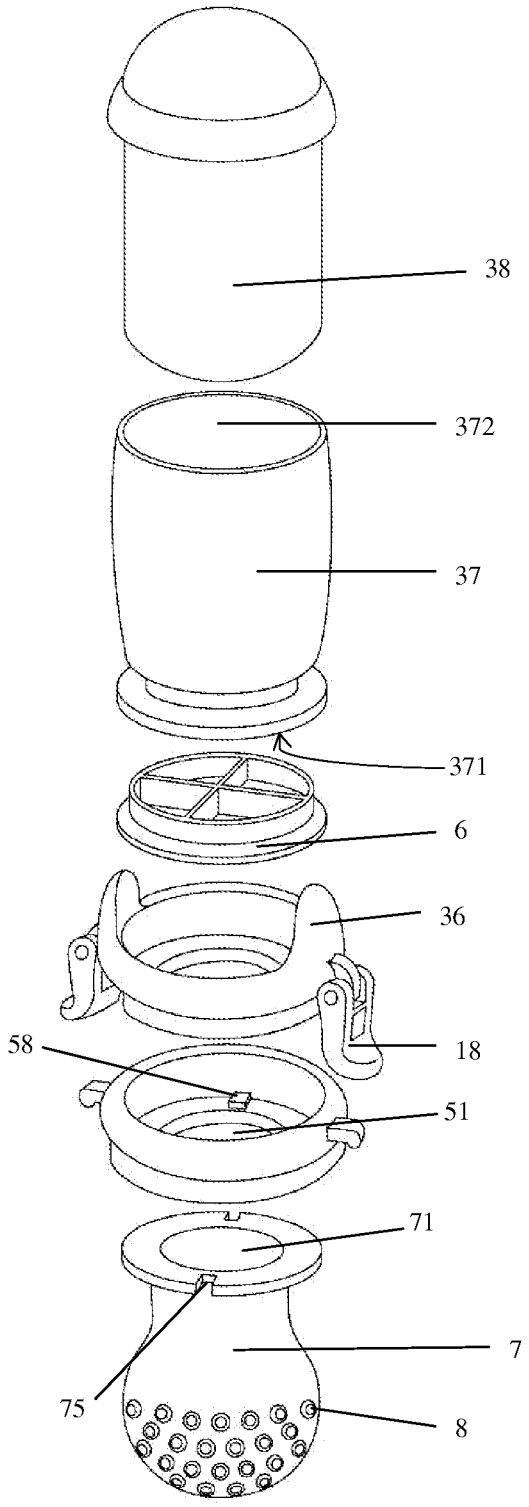
FIG. 23 is a partially exploded view of the fourteenth embodiment of the feeding apparatus.

As depicted in another embodiment in FIGS. 22 and 23, the food-squeezing unit may include a barrel 37 and a push member 38. The barrel 37 is hollow and has a second opening 371 at one end and a third opening 372 at the other end. The push member 38 is slidably movable inside the barrel 37. The barrel 37 may be connected to the body 36. The food can be placed in the barrel 37. The push member 38 can be pushed towards the food container 7 with great pressure thereby forcing the food inside the barrel to move towards the food container 7. It can be seen that the open end 71 of the food container 7, the first coupling member 5, the body 36 of the second coupling member 3, the second opening 371 and the third opening 372 of the barrel 37, and the push member 38 have circular outer configuration. The feeding apparatus shown in FIGS. 22 and 23 may also include the intermediate member 6.

Figure 24:
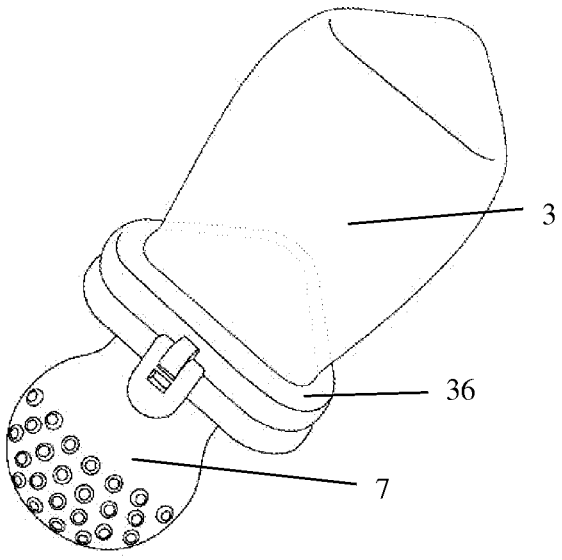
FIG. 24 is a perspective view of the fifteenth embodiment of the feeding apparatus.
Figure 25:
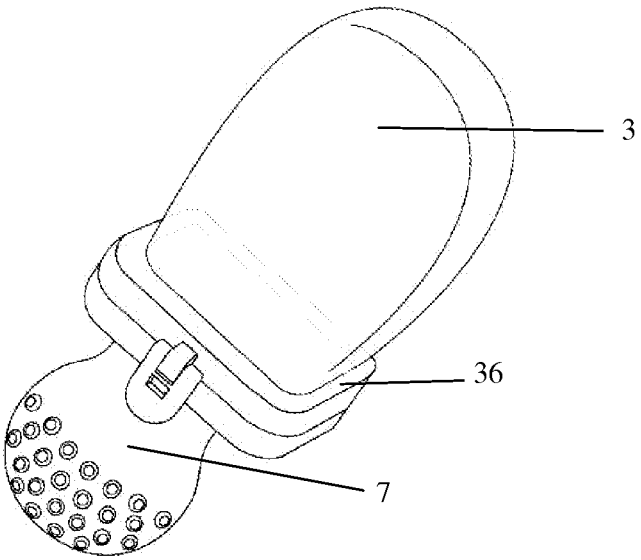
FIG. 25 is a perspective view of the sixteenth embodiment of the feeding apparatus.

As shown in FIG. 24, the open end 71 of the food container 7, the first coupling member 5, the body 36 of the first and second coupling members, the second opening 351 of the food-squeezing unit 35 can have a generally triangular outer configuration. The three acute angles of the triangular outer configuration can be rounded. As shown in FIG. 25, the open end 71 of the food container 7, the first coupling member 5, the body 36 of the first and second coupling members, the second opening 351 of the food-squeezing unit 35 can have a generally rectangular outer configuration. The four angles of the rectangular outer configuration can be rounded. These two feeding apparatus designs do not have unhygienic dead corners that would cause hygiene problem and are easy to clean.

According to the requirements, the protrusions 81 can be located at any positions on the outer surface of the food container 7. As shown in FIG. 16, the protrusions 81 are formed at a lower portion of the closed end of the food container 7. The protrusions 81 may also be formed between adjacent apertures 8. The above-mentioned embodiment applies to food container 7 with protrusions 81 at different locations.

The intermediate member 6 is not a necessary feature of the feeding apparatus disclosed in the present application. According to the requirements, the intermediate member 6 may or may not be provided on the feeding apparatus. Also, the position-fixing mechanism is not a necessary feature of the feeding apparatus. According to the requirements, the position-fixing mechanism may or may not be provided on the feeding apparatus. There may be three kinds of food container 7 that can be provided on a feeding apparatus, namely (i) food container 7 without protrusions; (ii) food container 7 with protrusions formed on the outer surface; and (iii) food container 7 with protrusions formed between adjacent first apertures.

Figure 41:
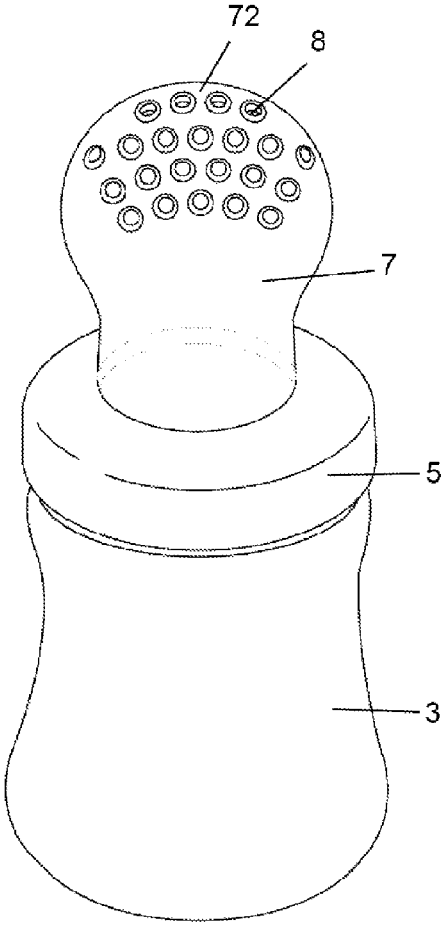
FIG. 41 is a perspective view of the eighteenth embodiment of the feeding apparatus.
Figure 42:
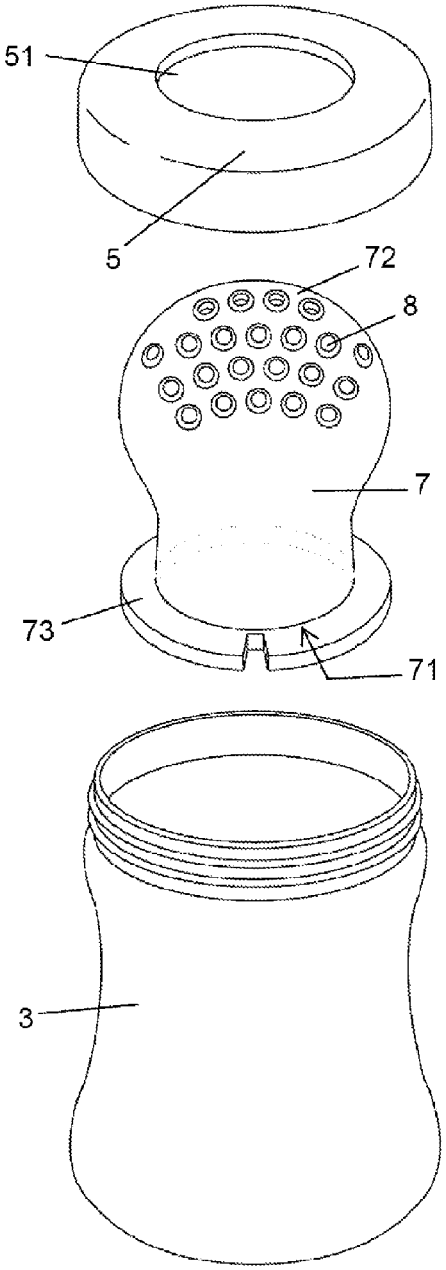
FIG. 42 is an exploded view of the eighteenth embodiment of the feeding apparatus.
Figures 43, 44:
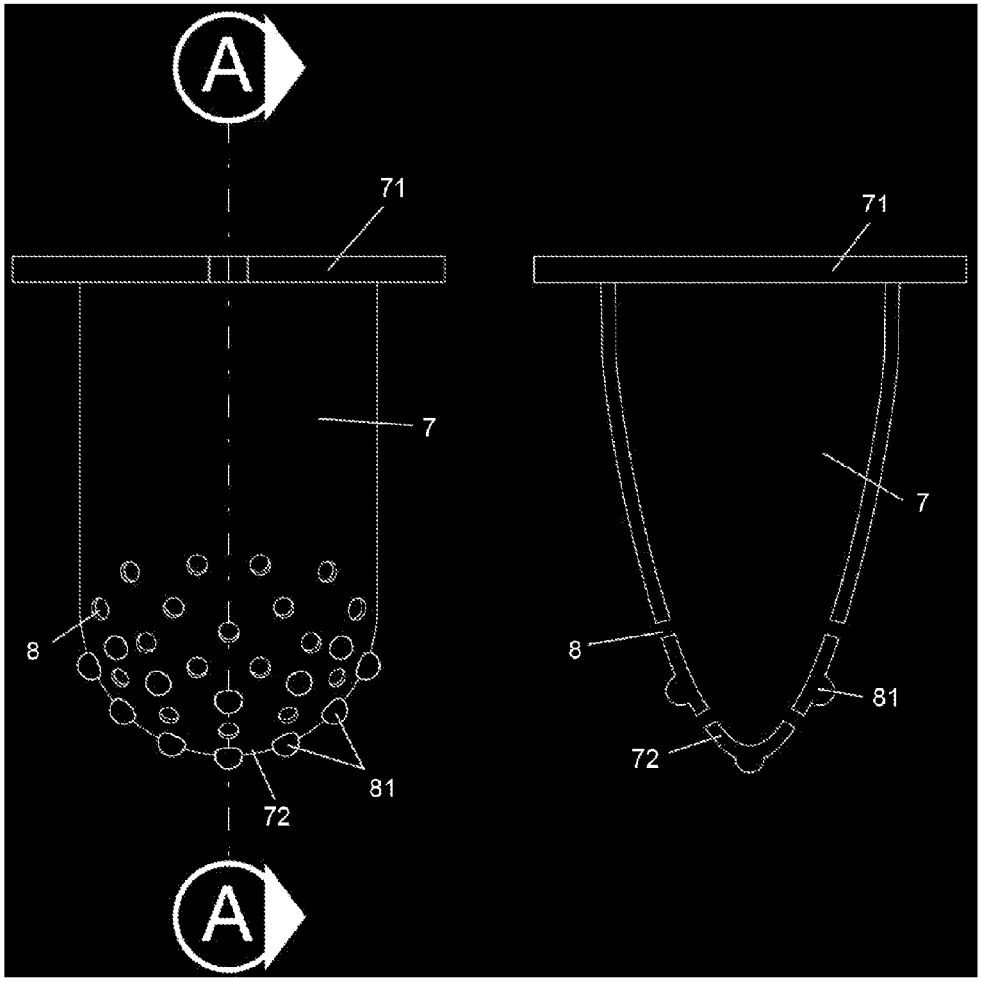
FIG. 43 is a side view of a seventh embodiment of the food-dispensing member of the feeding apparatus.
FIG. 44 is a cross sectional view taken along line A-A of the food-dispensing member of FIG. 43.
Figures 45, 46:
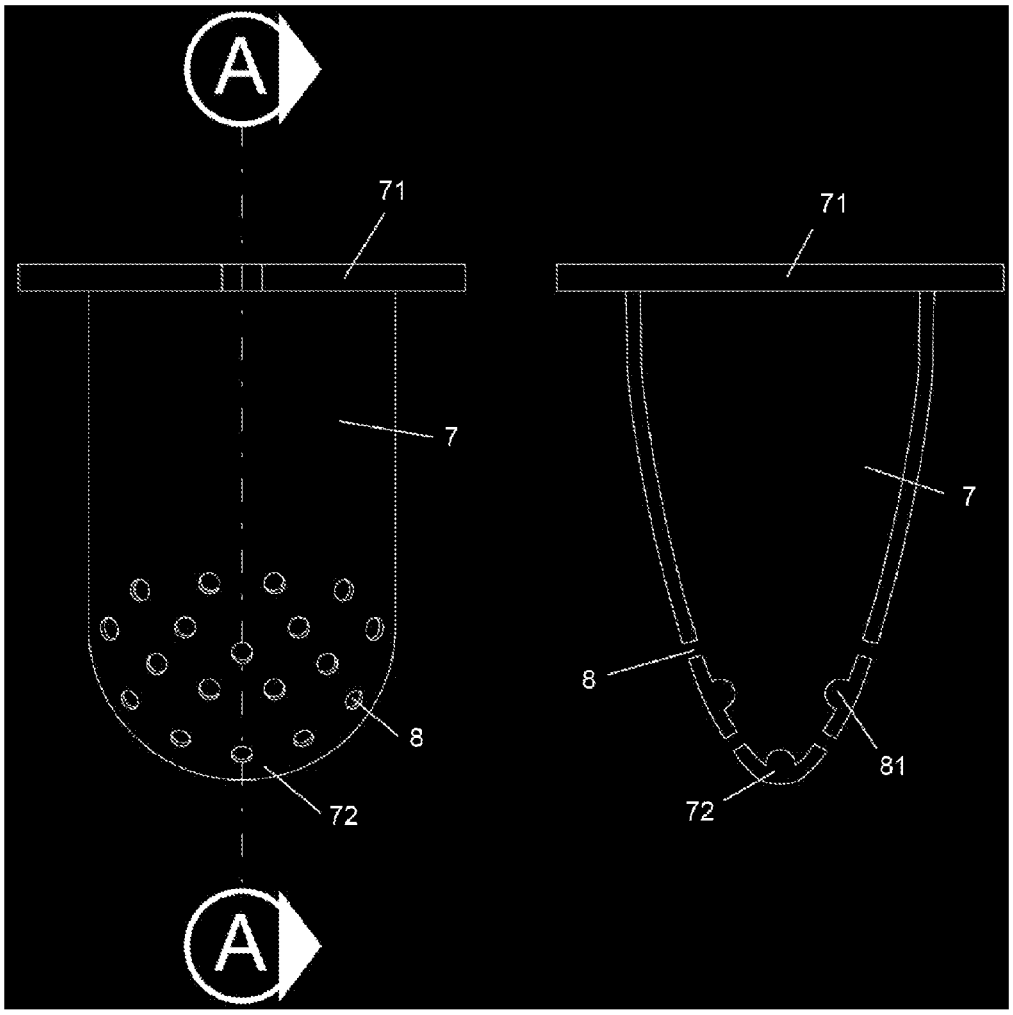
FIG. 45 is a side view of an eighth embodiment of the food-dispensing member of the feeding apparatus.
FIG. 46 is a cross sectional view taken along line A-A of the food-dispensing member of FIG. 47.
Figure 47:
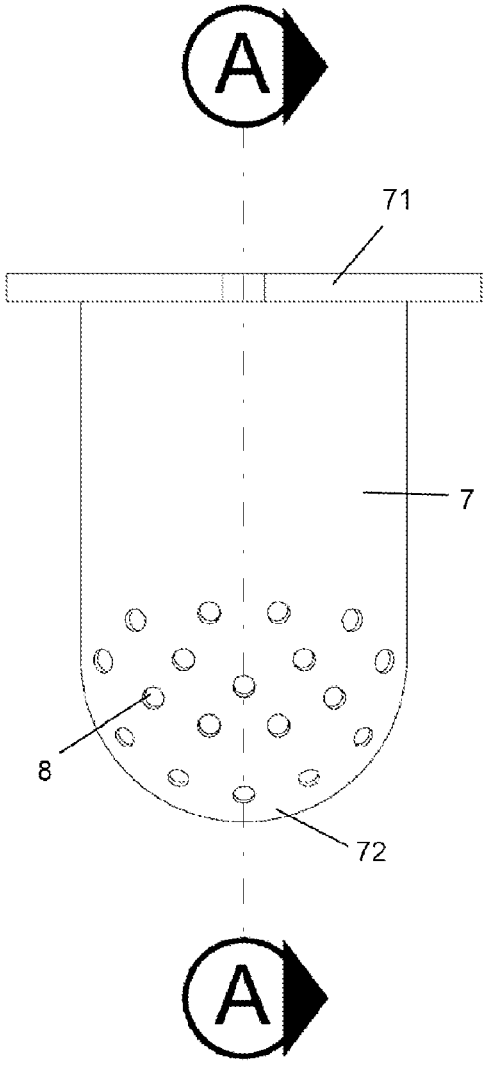
FIG. 47 is a side view of a ninth embodiment of the food-dispensing member of the feeding apparatus.
Figure 48:
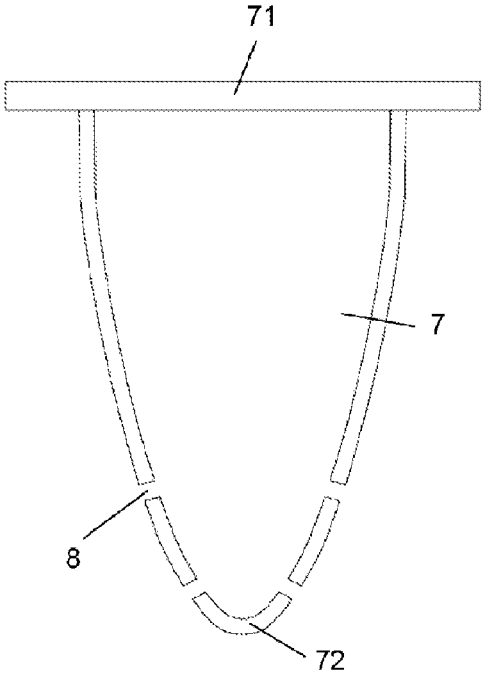
FIG. 48 is a cross sectional view taken along line A-A of the food-dispensing member of FIG. 47.
Figures 49, 50:
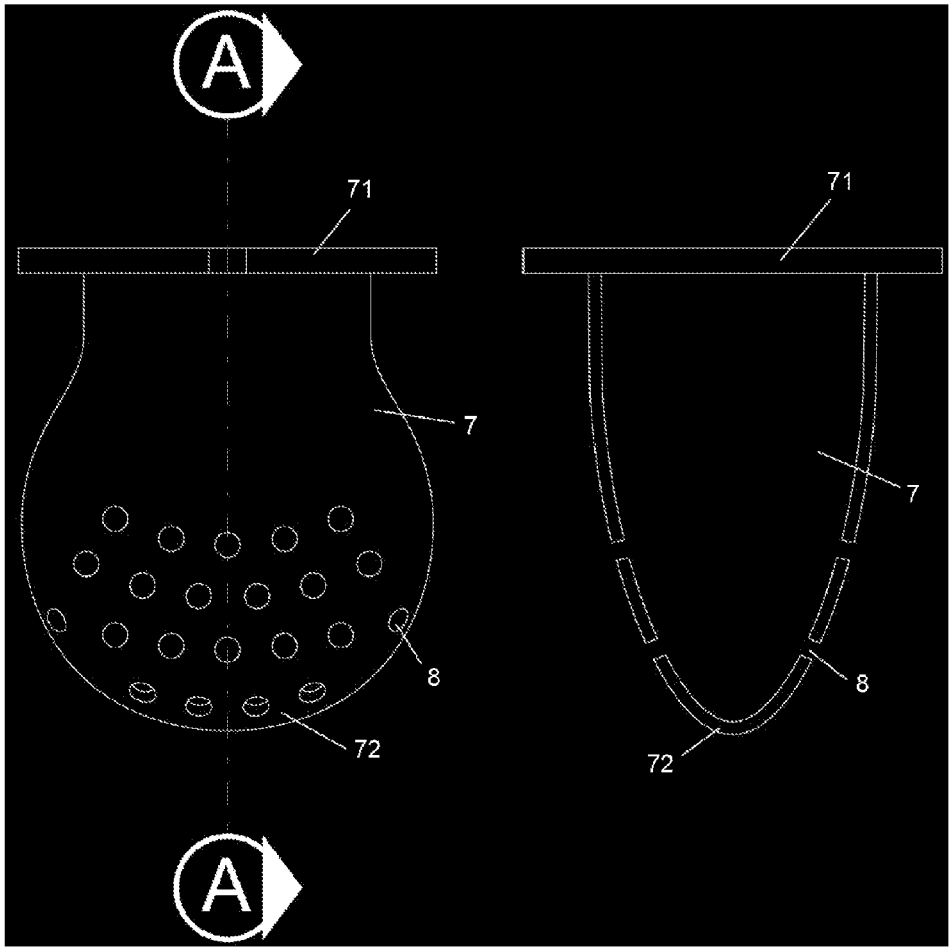
FIG. 49 is a side view of a tenth embodiment of the food-dispensing member of the feeding apparatus.
FIG. 50 is a cross sectional view taken along line A-A of the food-dispensing member of FIG. 49.
Figures 51, 52:
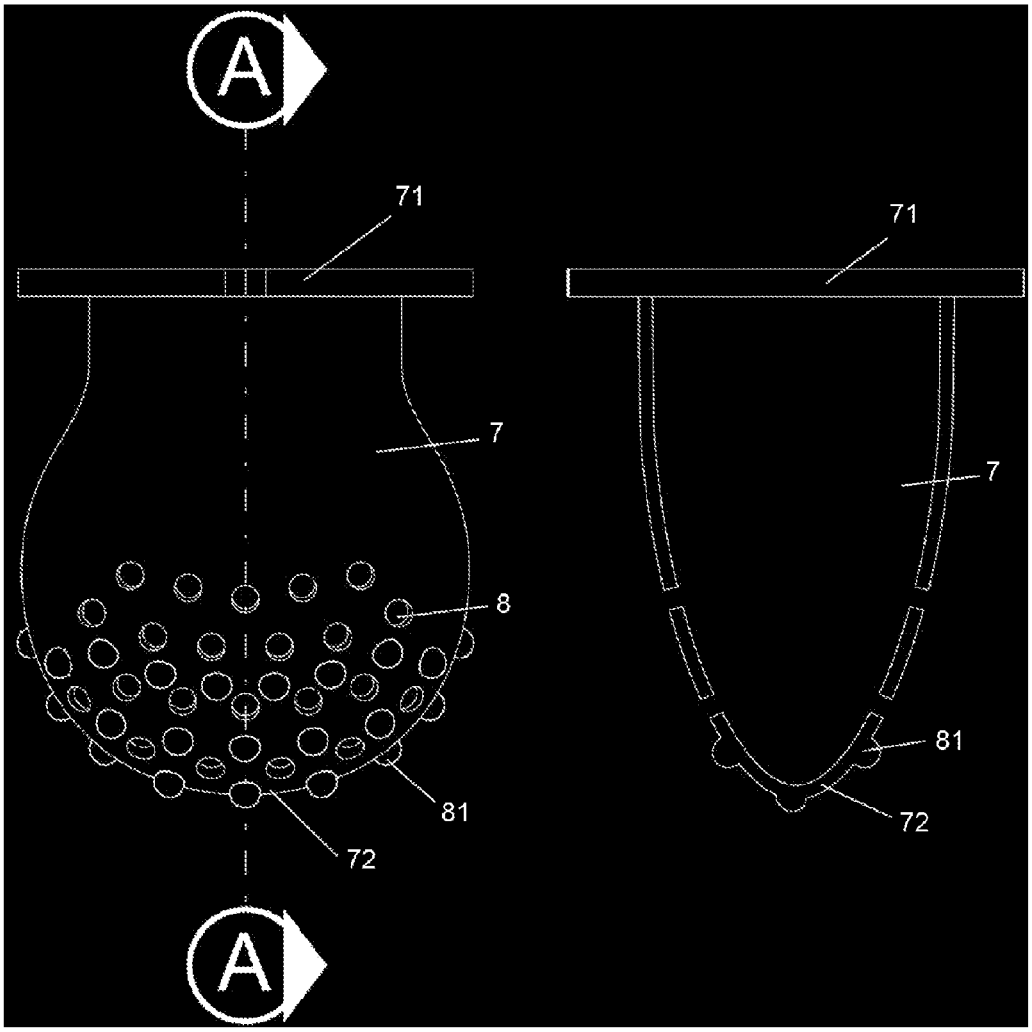
FIG. 51 is a side view of an eleventh embodiment of the food-dispensing member of the feeding apparatus.
FIG. 52 is a cross sectional view taken along line A-A of the food-dispensing member of FIG. 51.
Figure 53:
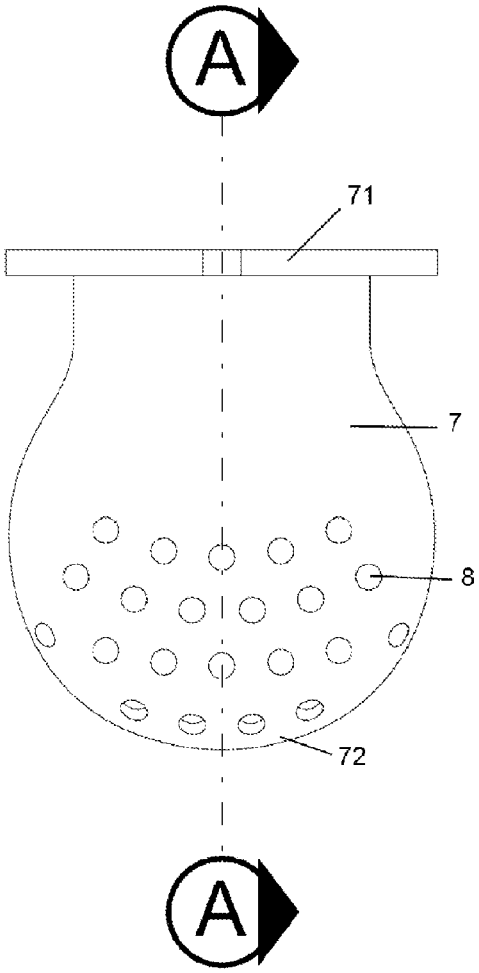
FIG. 53 is a side view of a twelfth embodiment of the food-dispensing member of the feeding apparatus.
Figure 54:
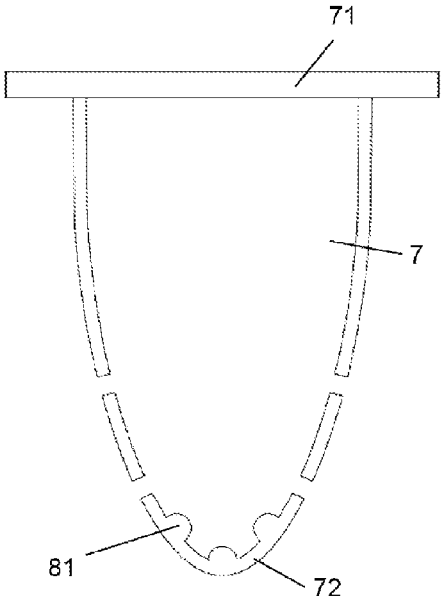
FIG. 54 is a cross sectional view taken along line A-A of the food-dispensing member of FIG. 53.

As shown in FIGS. 41 and 42, the feeding apparatus may include a food container 7, a first coupling member 5, and a second coupling member 3. The food container 7 has an open end 71 and a closed end 72. The first coupling member 5 includes an opening 51. The food container 7 can be detachably coupled to the first coupling member 5. When the food container 7 is coupled to the first coupling member 5, the open end 71 of the food container 7 is in communication with the opening 51 of the first coupling member 5. The second coupling member 3 can be cooperating with the first coupling member 5 and movable between an open configuration and a sealed configuration. The food container 7 may be provided with a plurality of apertures 8. The second coupling member 3 may be in the form of a milk bottle.

In FIGS. 41 and 42, the milk bottle may be threadably connected to the first coupling member 5. When the milk bottle is screwed onto the first coupling member 5, a sealed configuration can be formed between them. When the milk bottle is unscrewed from the first coupling member 5, an open configuration is formed. It is understood that the milk bottle and the first coupling member 5 can be connected together by other appropriate mechanism such as fasteners. A user can place the food (such as syrup, rice cereal, porridge, etc.) into the milk bottle and feed a baby or infant with the food container 7.

A radially outwardly extending annular flange 73 is provided at the open end 71 of the food container 7. In the sealed configuration, the annular flange 73 rests on a radially inwardly extending annular shoulder or platform 54 of the first coupling member 5, and can be clamped between the annular platform 54 and the second coupling member 3. In the open configuration, the annular flange 73 can be removed from the annular platform 54 of the first coupling member 5.

The food container 7 may be made of resilient material. The outer and/or the inner surface of the food container 7 may be provided with protrusions 81. The protrusions 81 may be formed around the first apertures. The protrusions may be formed between two adjacent first apertures. The apertures 8 may be circular in shape with a diameter of about 1 mm to 5 mm. There may be at least two apertures 8. The dimension of the first aperture closer to the closed end may be smaller than the dimension of the first aperture farther from the closed end. The distance between two apertures 8 is about 2 mm to about 10 mm.

The food-dispensing member of the feeding apparatus (which is the food container in the above embodiments) will now be described in detail. As shown in FIGS. 29-40, the food-dispensing member of a feeding apparatus includes a food container 7 made of a resilient material for use with foodstuff. The food container 7 may include an open end 71 and a closed end 72. The surface of the food container 7 may be provided with apertures 8 and protrusions 81.

The protrusions 81 can be used to massage the gum, relief discomfort during teething, benefit the growth and development of gum and teeth of an infant or baby. The protrusions 81 can also strengthen the gum and enhance chewing capability. During the feeding process, the saliva of the infant or baby can enter the food container 7 through the apertures 8 thereby (digesting) the food to promote feeding and digestion. One can put an infant or baby's favorite food inside the food container 7. Infant or baby would like to eat the food and have the gum massaged while eating the food. The feeding apparatus with protrusions 81 can therefore serve as a more effective teether compared to conventional tasteless teething apparatus.

The food-dispensing member in the present application can be formed into a chewing container that can fully provide the necessary condition and environment (saliva, etc.) for chewing activities. Babies are able to actively eat the food thereby leading to early development of their brains. Since the food container 7 is made of a resilient material, it can maintain its original shape and softness thereby maintaining its original food-carrying space and providing a chewing space that would benefit the chewing of the food inside the food container. The existing food-dispensing member of feeding apparatus (such as a mesh)

can only make a baby swallow passively. It cannot make a baby actively eat the food or even induce a baby to chew.

The shape of the apertures 8 may vary according to the need. For example, the apertures 8 may have the shape of a circle, square or triangle, etc. The dimension of the apertures 8 may vary according to the need so as to control the amount and rate of the flow of the food. When the first aperture 8 is circular in shape, its diameter may be about 1 mm to about 5 mm.

The number of apertures 8 can be adjusted depending on the need and the rate of food consumption. A food container 7 usually has at least two first apertures. For example, the food container 7 may have 10 apertures or 20 first apertures. At the same time, the distance between the apertures 8 can be adjusted depending on the need and the rate of food consumption. Usually, the distance between two apertures 8 is about 2 mm to about 10 mm. For example, the distance between two apertures 8 can be 2 mm, 4 mm, 6 mm or 10 mm.

The thickness of the food container 7 can be adjusted according to the need of the chewing force of a baby or infant. For example, the thickness of the food container can be about 1 mm to about 6 mm. This is quite suitable for babies that are learning to eat.

As shown in FIGS. 29-40, the food container 7 may be in the shape of a nipple of a conventional milk bottle, or a flattened nipple of a milk bottle. The food container 7 may tapers into a rounded end. The shape of the food container 7 may generally conform to the shape of the mouth of an infant. These food container designs can facilitate baby feeding and induce baby's food taking. It is understood that the food container 7 may be in other shapes in order to meet other requirements.

The food container 7 may be made of durable material such that it can be repeatedly used. The food container 7 may be made of colored material such that it can attract the curiosity of babies and infants and induce them to consume the food. The food container 7 may be made of transparent material allowing a person to readily see through the food container 7 and know whether the container 7 is full or empty.

The food container 7 may be made of a soft resilient material suitable for use with foodstuff. This soft resilient material for foodstuff use may include silicone or latex, or rubber or polyvinyl chloride (PVC) for foodstuff use. Silicone material is non-toxic, environmental-friendly, wear resistant, resistant to high and low temperatures, and aging resistant. Products made of silicone are more environmental-friendly, more safe and more durable.

Figures 29, 30:
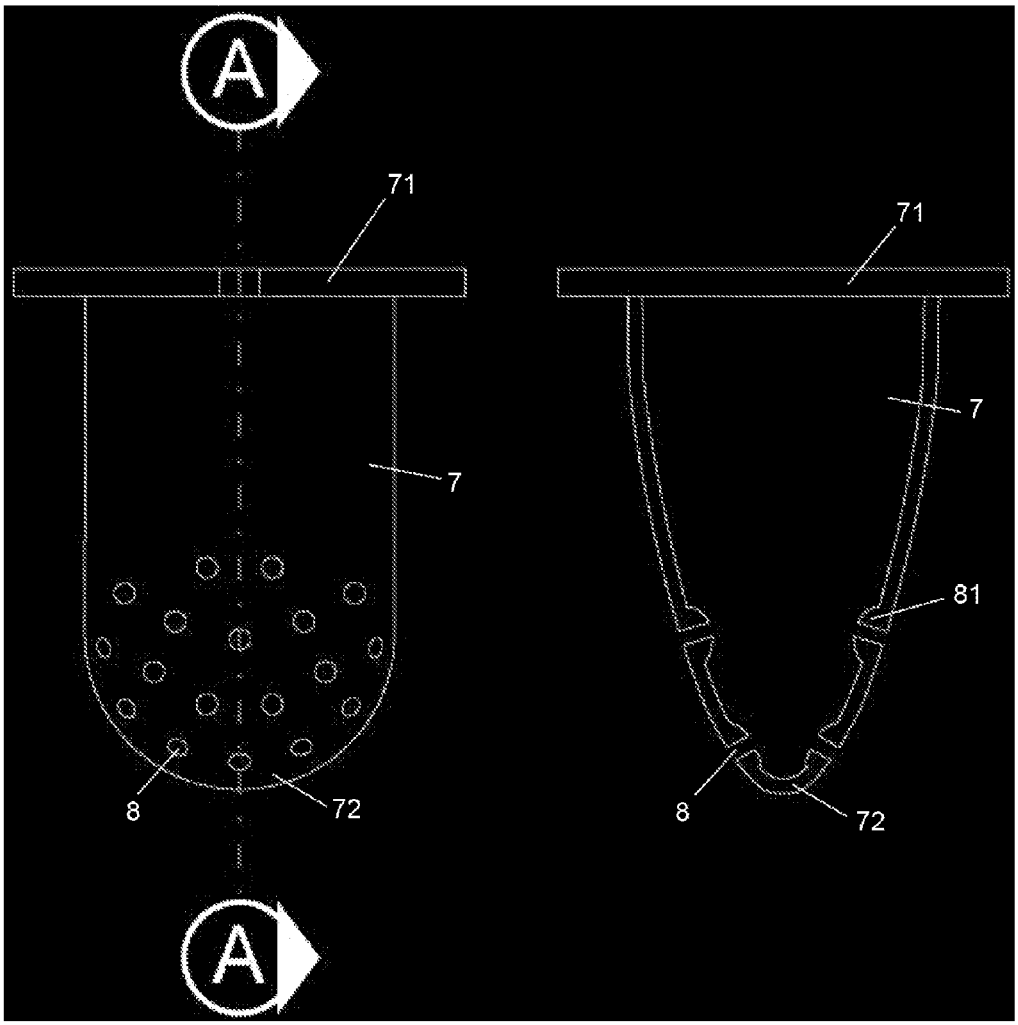
FIG. 29 is a side view of a first embodiment of the food-dispensing member of the feeding apparatus.
FIG. 30 is a cross sectional view taken along line A-A of the food-dispensing member of FIG. 29.
Figure 31:
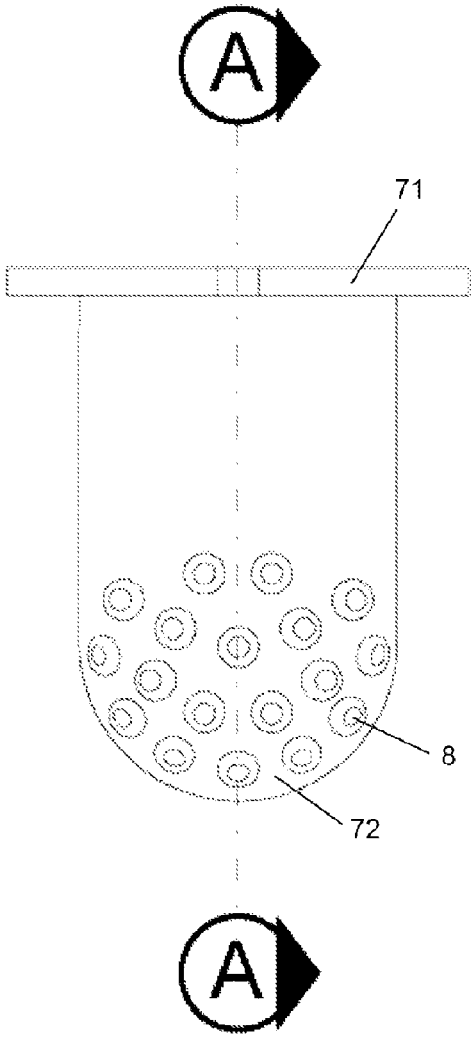
FIG. 31 is a side view of a second embodiment of the food-dispensing member of the feeding apparatus.
Figures 37, 38:
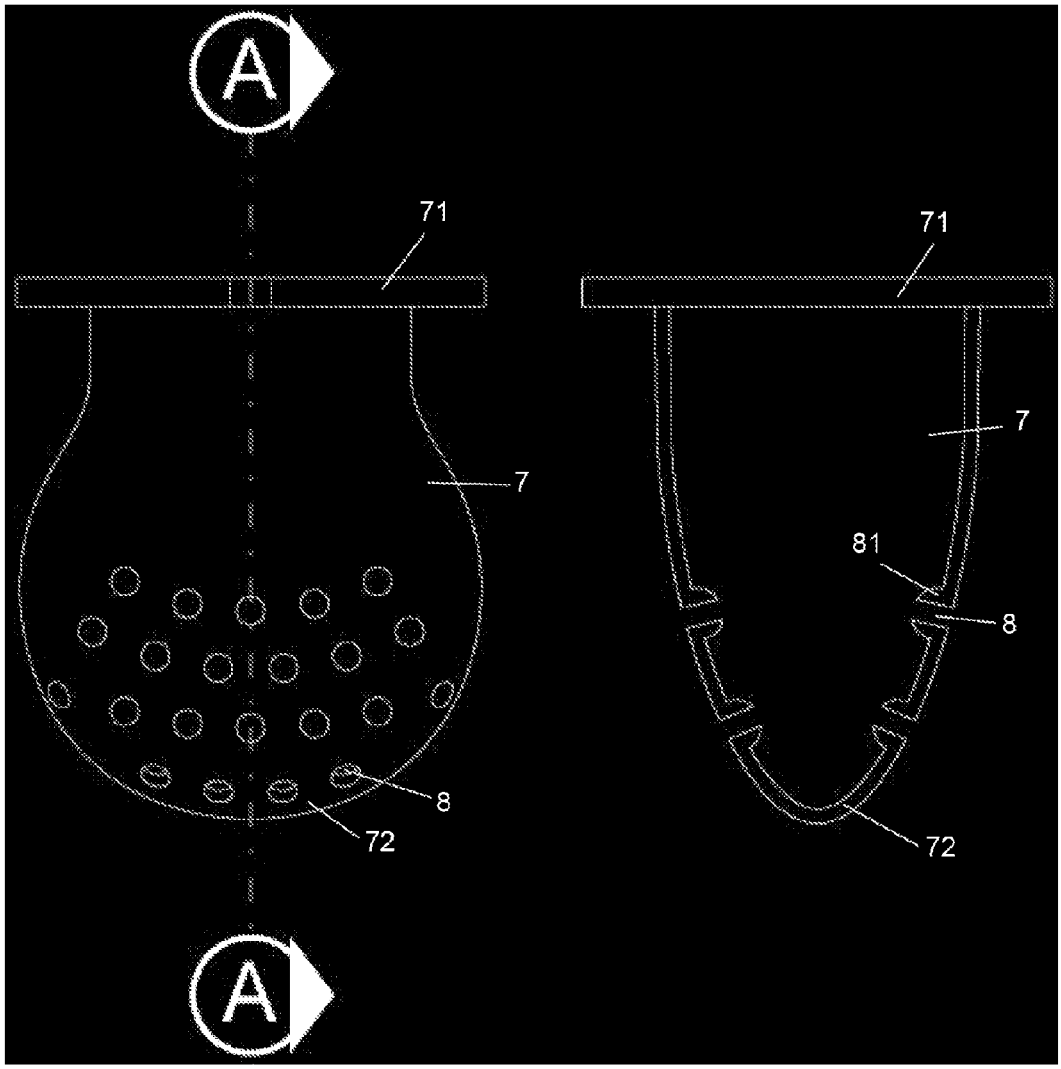
FIG. 37 is a side view of a fifth embodiment of the food-dispensing member of the feeding apparatus.
FIG. 38 is a cross sectional view taken along line A-A of the food-dispensing member of FIG. 37.
Figure 39:
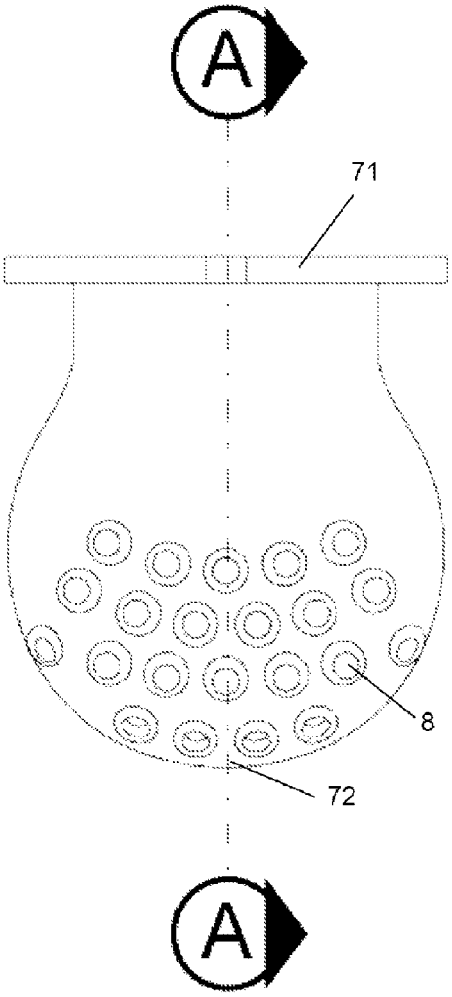
FIG. 39 is a side view of a sixth embodiment of the food-dispensing member of the feeding apparatus.

The protrusions 81 can be formed at any location of the food container 7 so long as babies and infants can touch and feel them during feeding. For example, in FIGS. 34 and 36, the protrusions 81 are formed on the outer surface of the food container 7. As shown in FIGS. 30 and 38, the protrusions 81 are formed on the inner surface of the food container 7. Since the food container 7 is made of a relatively soft resilient material, babies and infants can feel them and use them to massage the gum even though they are formed on the inner surface of the food container 7. When babies and infants bite the food container 7 such that the opposite sides of the food container 7 are in touch with each other, the feeling of the protrusions 81 is even stronger. When the protrusions 81 are formed on the inner surface of the food containers, babies and infants can feel that the protrusions 81 are softer and that that it is more comfortable during gum massaging.

Figure 32:
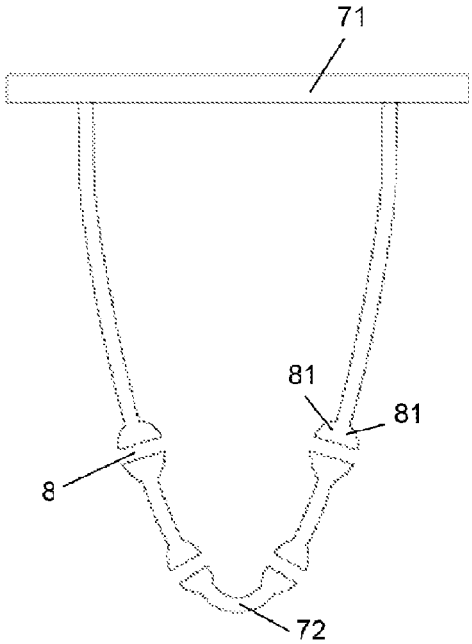
FIG. 32 is a cross sectional view taken along line A-A of the food-dispensing member of FIG. 31.
Figure 33:
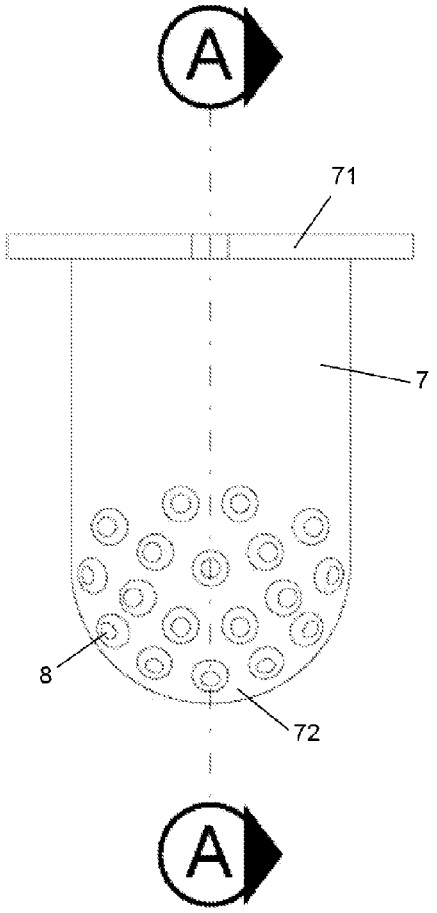
FIG. 33 is a side view of a third embodiment of the food-dispensing member of the feeding apparatus.
Figure 34:
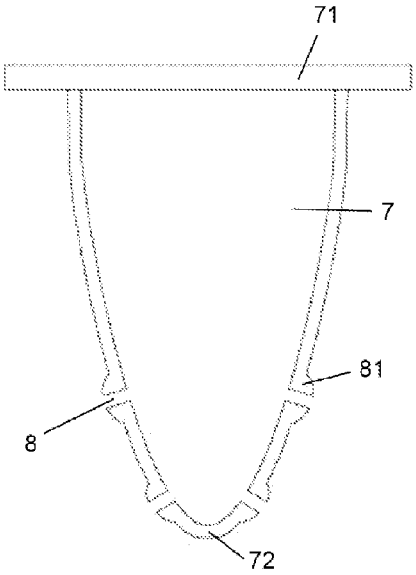
FIG. 34 is a cross sectional view taken along line A-A of the food-dispensing member of FIG. 33.
Figure 35:
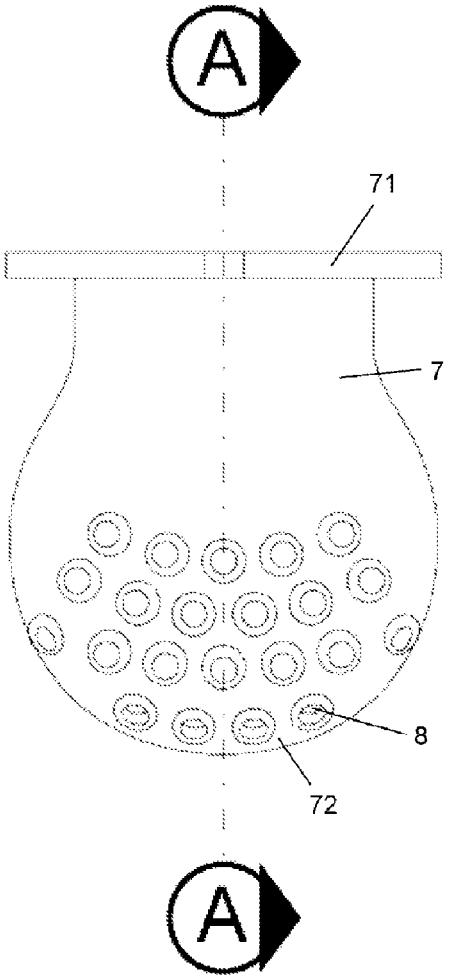
FIG. 35 is a side view of a fourth embodiment of the food-dispensing member of the feeding apparatus.
Figure 36:
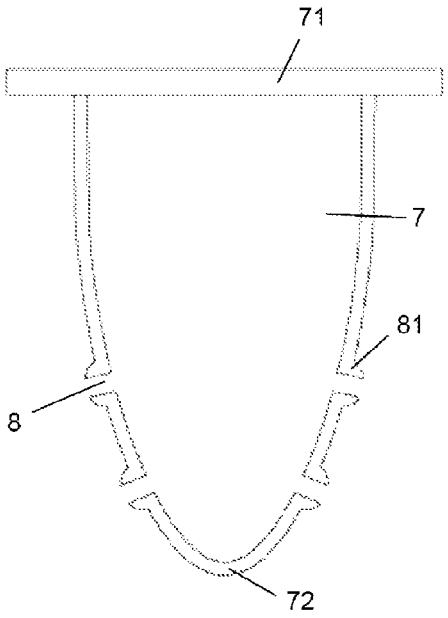
FIG. 36 is a cross sectional view taken along line A-A of the food-dispensing member of FIG. 35.
Figure 40:
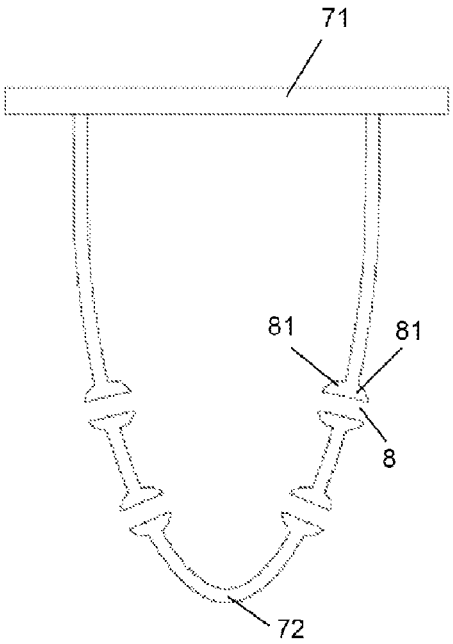
FIG. 40 is a cross sectional view taken along line A-A of the food-dispensing member of FIG. 39.

As shown in FIGS. 32 and 40, the protrusions 81 can be formed on both the outer and inner surfaces of the food container. As shown in FIGS. 29-40, the protrusions 81 can be formed around the apertures 8. As shown in FIGS. 43-46 and 51-54, the protrusions 81 can be formed between adjacent apertures 8. As shown in FIGS. 43, 44, 51 and 52, the protrusions 81 can be formed on the outer surface of the food container 7 between adjacent apertures 8. As shown in FIGS. 45, 46, 53, 54, the protrusions can be formed on the inner surface of the food container 7 between adjacent apertures 8. As shown in FIG. 16, the protrusions 81 can be formed at a lower portion of the closed end 72 of the food container 7.

The dimension of the apertures 8 may vary. For example, the dimension of the apertures closer to the closed end is smaller than the dimension of the apertures farther from the closed end. For example, when the apertures are circular in shape, the apertures closer to the closed end may have a diameter of 1 mm and the apertures farther to the closed end may have a diameter larger than 1 mm. This can prevent the liquid inside the food container 7 from leaking out so as to facilitate the placing of food with juice inside the food container 7.

Figure 55A:
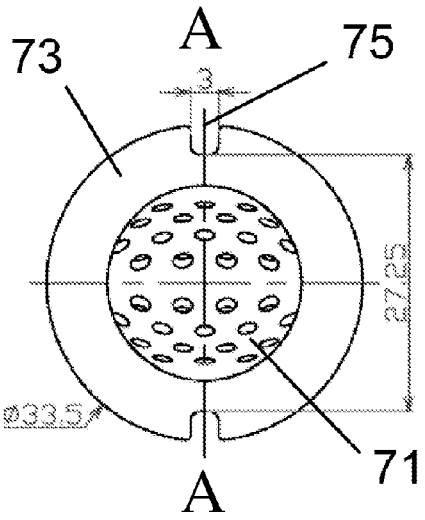
FIG. 55 *a* is a top view of a thirteenth embodiment of the food-dispensing member of the feeding apparatus.
Figure 55B:
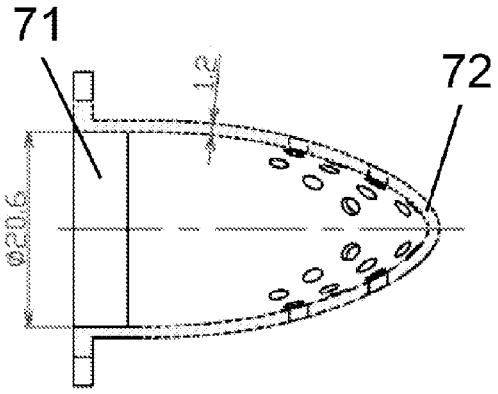
Figure 55C:
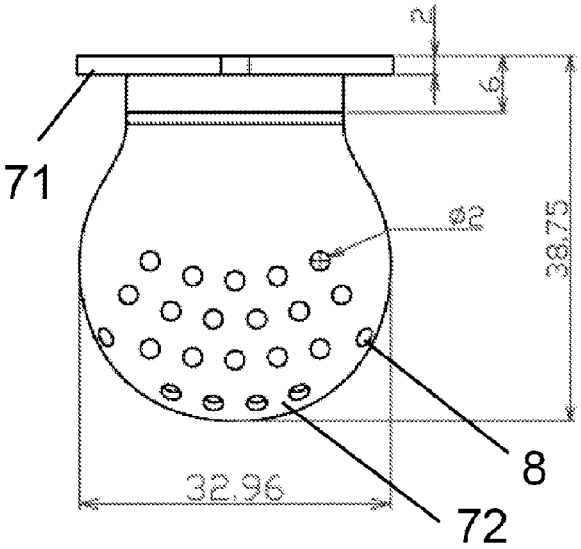
Figure 56A:
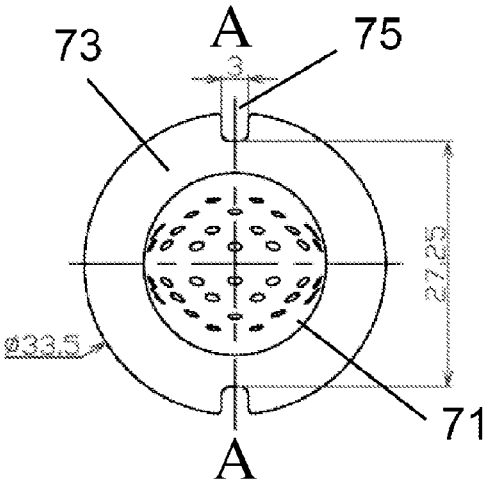
FIG. 56 *a* is a top view of a fourteenth embodiment of the food-dispensing member of the feeding apparatus.
Figure 56B:
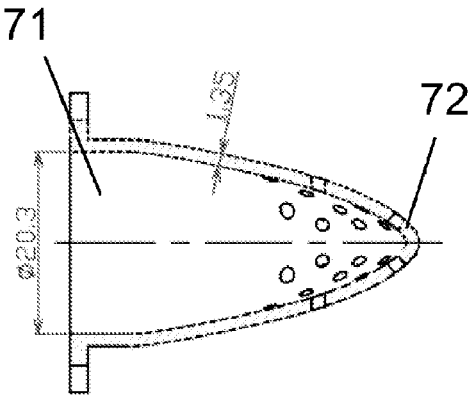
Figure 56C:
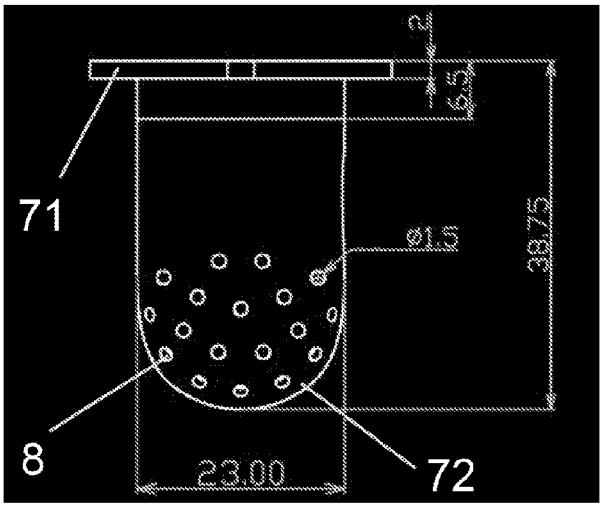

The dimension of the food container 7 can be adjusted according to the need. In one embodiment, for example, the thickness of the food container 7 can be about 1.2 mm. The annular flange 73 at the open end 71 may have an inner diameter of 20.6 mm and an outer diameter of 33.5 mm. The annular flange 73 may have a thickness of 2 mm. The notch 75 on the annular flange 73 may have a width of 3 mm. The distance between the two opposite notches 75 can be 27.25 mm. The food container 7 may have a height of 38.75 mm and a width of 32.96 mm. The diameter of the apertures 8 is 2 mm. As shown in the embodiment in FIGS. 55 *a*, 55 *b*, and 55 *c*, the thickness of the food container 7 is 1.2 mm. The annular flange 73 at the open end 71 may have an inner diameter of 20.6 mm and an outer diameter of 33.5 mm. The annular flange 73 may have a thickness of 2 mm. The notch 75 on the annular flange 73 may have a width of 3 mm. The distance between the two opposite notches 75 can be 27.25 mm. The food container 7 may have a height of 38.75 mm and a width of 32.96 mm. The diameter of the apertures 8 is 2 mm. As shown in the embodiment in FIGS. 56 *a*, 56 *b*, and 56 *c*, the thickness of the food container 7 is 1.35 mm. The annular flange 73 at the open end 71 may have an inner diameter of 20.3 mm and an outer diameter of 33.5 mm. The annular flange 73 may have a thickness of 2 mm. The notch 75 on the annular flange 73 may have a width of 3 mm. The distance between the two opposite notches 75 can be 27.25 mm. The food container 7 may have a height of 38.75 mm and a width of 23 mm. The diameter of the apertures 8 is 1.5 mm.

The feeding apparatus of the present application can facilitate the feeding of food by the food container. The rate of flowing of the food can be controlled by the apertures so that it is not easy for the food to leak out from the food container. Comparing to conventional feeding apparatus, the feeding apparatus of the present application is more clean, hygienic and easy to use. Other utensils such as fork, knife and spoon are not required for feeding. The feeding apparatus can be used not only by babies and infants but also by handicapped people, elderly people and people having illness. The feeding apparatus of the present application can even be used in weightless space environment. Food can stay in the food container and ensure cleanliness during food taking.

It is understood by one skilled in the art that different food containers can be used in cooperation with different feeding apparatuses While the feeding apparatus disclosed in the present application has been shown and described with particular references to a number of preferred embodiments thereof, it should be noted that various other changes or modifications may be made without departing from the scope of the appending claims.

The invention claimed is:

1. A feeding apparatus comprising:

a food container, the food container comprising an open end and a closed end, the food container being provided on a surface thereof with one or more apertures closer to the closed end and one or more apertures farther from the closed end, and at least a portion of the food container proximate to the closed end being substantially in an elliptical shape when viewed from above the closed end, wherein the apertures are located on the elliptical shaped portion of the food container substantially parallel to the major axis of the elliptical shaped portion of the food container, at least a portion of the food container proximate to the open end being substantially in a circular shape when viewed from above the open end, the open end of the food container comprising a flange, and the food container being made of a resilient material for use with foodstuff;

a first coupling member comprising a platform, and an opening in communication with the container open end, the food container being engaged with the first coupling member; and a second coupling member cooperating with the first coupling member and movable between an open configuration allowing food to pass through the opening and into the food container, and a sealed configuration where the second coupling member covers the opening of the first coupling member thereby sealing the open end of the food container, the second coupling member comprising a first protruding plug portion which snugly plugs into and seals the opening of the first coupling member when the second coupling member is in the sealed configuration, the second coupling member comprising a second protruding plug portion extending from the first protruding plug portion which snugly plugs into and seals the opening of the food container when the second coupling member is in the sealed configuration, wherein the flange comprises a first position indicator, and the platform comprises a second position indicator, such that when the first position indicator and the second position indicator are aligned, the food container is in a desired rotational position, wherein the second coupling member further comprises a handle comprising at least two portions extending perpendicular to the second coupling member, wherein a major axis of the elliptical shaped portion of the food container is aligned with an axis between the handle extensions when the second coupling member is in the sealed configuration and the food container is in the desired rotational position;

wherein the open end of the food container comprises a flange which is adapted to be clamped between the platform of the first coupling member and the first protruding plug portion of the second coupling member, a bottom surface of the first protruding plug portion is pressed against a top surface of the flange of the food container, and a bottom surface of the flange of the food container is pressed against the platform of the first coupling member when the second coupling member is in the sealed configuration.

2. The feeding apparatus as claimed in claim 1, wherein the distance between two adjacent apertures is about 2 mm to about 10 mm.

3. The feeding apparatus as claimed in claim 1, wherein the food container further comprise a plurality of protrusions, the protrusions are formed between two adjacent apertures.

4. The feeding apparatus as claimed in claim 1, wherein the resilient material for use with foodstuff is selected from the group consisting of silicone, latex, and rubber.

5. The feeding apparatus as claimed in claim 1, wherein the food container is generally in the shape of a nipple of a milk-feeding bottle.

6. The feeding apparatus as claimed in claim 1, wherein the thickness of the food container is about 1 mm to about 6 mm.

* * * * *